US006225992B1

(12) United States Patent
Hsu et al.

(10) Patent No.: US 6,225,992 B1
(45) Date of Patent: May 1, 2001

(54) METHOD AND APPARATUS FOR GENERATING BIAS VOLTAGES FOR LIQUID CRYSTAL DISPLAY DRIVERS

(75) Inventors: Jerry Hsu, Tainan; Wesley Chen, Hsinchu; Chris Hung, Taichung; Michael Cheng, Chung-Thunst, all of (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 08/985,682

(22) Filed: Dec. 5, 1997

(51) Int. Cl.[7] ..... G09G 5/00; G05F 1/10

(52) U.S. Cl. ..... 345/211; 345/212; 345/204; 327/544

(58) Field of Search ..... 345/211, 212, 345/95, 96, 94, 204; 327/544

(56) References Cited

U.S. PATENT DOCUMENTS 4,141,002 * 2/1979 Reinhold ..... 345/211
5,130,703 * 7/1992 Fairbanks et al. ..... 345/94
5,517,212 * 5/1996 Inoue ..... 345/211
5,625,387 * 4/1997 Moon ..... 345/211
5,745,092 * 4/1998 Ito ..... 345/211
5,867,057 * 2/1999 Hsu et al. ..... 327/544
5,877,737 * 3/1999 Kim et al. ..... 345/211

FOREIGN PATENT DOCUMENTS 63-188120 8/1988 (JP) .
9-311310 12/1997 (JP) .

* cited by examiner

*Primary Examiner*—Matthew Luu
*Assistant Examiner*—Anthony J. Blackman
(74) *Attorney, Agent, or Firm*—Rabin & Champagne, P.C.

(57) ABSTRACT

An apparatus and method is provided for generating a set of bias voltages for a liquid crystal display (LCD) driver to drive an LCD panel. This apparatus and method are directed to solving the problems of excessive use of I/O pads and power consumption in conventional LCD drivers and also the problems of the non-matching between externally connected resistors and the internal resistance in conventional LCD drivers. Further, externally connected capacitors for increasing bias current in conventional LCD drivers are not needed. The apparatus and method is capable of switching a bias current to a top level which causes a voltage divider to provide adequate bias voltages to the LCD driver at each instant when the LCD waveforms are being switched from one state to another, and to a bottom level when the LCD waveforms are at steady states so as to reduce power consumption to save energy.

69 Claims, 19 Drawing Sheets

METHOD AND APPARATUS FOR GENERATING BIAS VOLTAGES FOR LIQUID CRYSTAL DISPLAY DRIVERS

BACKGROUND OF THE INVENTION

1. Field of the Invention

This invention relates to liquid crystal display (LCD) devices, and more particularly, to an apparatus and method for generating a set of bias voltages for an LCD driver to drive an LCD panel, which can provide a large current for a voltage divider to provide adequate bias voltages to the LCD driver at the instant when the LCD waveforms are being switched from one state to another, and a small current in other times for reduced power consumption to save energy.

2. Description of Related Art

Liquid crystal display (LCD) devices are digital display devices widely used on digital watches, palmtop game machines, and various other electronic instruments for display of data or graphics thereon.

FIG. 1 is a schematic diagram of a conventional LCD device, which includes an LCD driver 10 for driving an LCD panel 14 to display data thereon. The LCD driver 10 is coupled to a voltage divider 12 consisting of a number of serially connected 100 kΩ resistors which can divide an external system voltage $V_{CC}$ into a number of apportioned voltages [$V_1$, $V_2$, $V_3$, $V_4$] which serve as bias voltages for the LCD driver 10 to output a plurality of analog LCD waveforms, including, for example, eight common signals COM1–COM8 and a number of segment signals SEG1–SEG40, to the LCD panel 14. These LCD waveforms represent the data or graphics that are to be displayed on the LCD panel 14.

Typically, the system voltage $V_{CC}$ is supplied by a battery unit. However, one drawback to batteries is that the output voltage thereof will be constantly decreasing during use. A brand new battery unit having an output voltage of 1.7 V (volt) at the beginning, for example, will be decreased in the output voltage to 1.2 V after a period of use. Therefore, for a battery unit consisting of three serially connected batteries, the output voltage thereof will be gradually decreased from 5.1 V (1.7V×3=5.1V) to 3.6 V (1.2V×3=3.6V) during the period of use. In a game machine (for example the BRICK GAME machine) having a resolution of 320 dots, the contrast ratio of the LCD panel thereof will be optimal when the output voltage of the battery unit is within the range from 3.8 V to 4.6 V. The contrast ratio will be overly high when the output voltage of the battery units is over 4.6 V during the beginning of use, and then become inadequate when the output voltage of the battery units is below 3.8 V near the end of the life of use.

The system voltage $V_{CC}$ is divided by the voltage divider 12 shown in FIG. 1 into a number of bias voltages [$V_1$, $V_2$, $V_3$, $V_4$] for the LCD driver 10 to drive the LCD panel 14. By conventional method, a variable resistor $V_R$ is connected in series to the voltage divider 12 for adjusting the magnitude of a DC current $I_d$ (hereinafter referred to as bias current) flowing through the resistors in the voltage divider 12. The resistance of $V_R$ is typically adjusted to a large value, but this will cause the bias voltage $I_d$ to be low. A conventional solution to this problem is to provide an array of capacitors [$C_1$, $C_2$, $C_3$, $C_4$] connected to the nodes where the bias voltages [$V_1$, $V_2$, $V_3$, $V_4$] are produced. These capacitors [$C_1$, $C_2$, $C_3$, $C_4$] can stabilize the bias voltages [$V_1$, $V_2$, $V_3$, $V_4$] and also allow for a large magnitude to the bias current $I_d$ at the instant when the LCD waveforms are being switched from one state to another.

The provision of the capacitors [$C_1$, $C_2$, $C_3$, $C_4$] shown in FIG. 1, however, needs an increased number of I/O pads on the IC chip of the LCD driver to connect, and represents an increase in component cost. For low-priced palmtop game machines, this means an increase in the manufacturing cost, which will cause the products less competitive on the market. Moreover, under the pad limit requirements, the increased number of I/O pads will force the manufacturer to use low-end fabrication processes (such as the 0.8 μm technology) instead of advanced ones (such as the 0.6 μm technology) to fabricate the IC chip of the LCD. In other words, when there is a limit to the number of I/O pads, the feature size of the IC chip cannot be further reduced even though the 0.6 μm fabrication process is used instead of the 0.8 μm technology.

It is, therefore, a primary research effort in the semiconductor industry to find a solution which allows the elimination of the above-mentioned capacitors (i.e., the capacitors [$C_1$, $C_2$, $C_3$, $C_4$] shown in FIG. 1) coupled to the LCD driver so as to reduce the component cost and also allow the use of the more advanced 0.6 μm technology to fabricate the LCD IC chip.

One solution is to lower the resistance of the resistors in the voltage divider so as to raise the magnitude of the bias current $I_d$ flowing through the voltage divider, thus allowing for an adequate level for the bias voltages supplied to the LCD driver. An inadequate level for the bias voltage would cause spikes to occur in the LCD waveforms.

One drawback to the foregoing solution, however, is that the bias current $I_d$ will be excessive that causes unnecessary power consumption and thus a waste of energy. For example, assume $V_{CC}$=5V and 100 kΩ resistors are used to constitute the voltage divider 12, the bias current $I_d$ flowing through the voltage divider 12 shown in FIG. 1 will be $$I_d = V_{CC}/(100\times5)\ \text{k}\Omega = 5/500 = 10\ \mu\text{A (microampere)}.$$

However, when 15 kΩ resistors are used in place of the 100 kΩ resistors in the voltage divider 12, the bias current $I_d$ will become $$I_d = V_{CC}/(15\times5)\ \text{k}\Omega = 5/75 = 67\ \mu\text{A},$$

which is significantly much larger than the previous 10 μA current. This large amount of current is not useful for the operation of the LCD driver 10 but wasted instead. This causes unnecessary power consumption.

The provision of capacitors coupled to the LCD driver is also an impractical scheme since it is impossible to provide an adequate capacitance to capacitors in an IC chip which is very small in size. To do this, the size of the IC chip will become large, which is usually not desired.

One practical solution to the foregoing problem is to connect a variable resistor $V_R$ in series to the voltage divider 12 as illustrated in FIG. 1, so as to adjust for a suitable level for the bias voltages. For example, when the output voltage of the battery unit exceeds 4.6 V, the variable resistor $V_R$ can be adjusted until the level of $V_{LCD}$ is lowered to 4.2 V (which is the optimal level for the LCD driver 10). On the other hand, when the output voltage of the battery unit is below 4.2 V, the variable resistor $V_R$ can be adjusted to zero resistance so as to provide the maximum possible level for $V_{LCD}$.

The foregoing solution of using the variable resistor $V_R$, however, is still not considered a satisfactory one to provide the best adjustment for the bias current. In view of this, an automatic brightness control apparatus for an LCD device is disclosed in ROC Publication No. 231,148. This patent has two preferred embodiments, respectively illustrated schematically in FIG. 2 and FIG. 3. As shown, the patent of ROC Publication No. 231,148 includes a microprocessor 20, a voltage divider 21, a resistor circuit 22, and an LCD panel 23. The microprocessor 20 is a 4-bit unit having a pair of input ports P8.0, P8.1 connected to the voltage divider 21 and a pair of output ports ALCD1, ALCD2 connected to the resistor circuit 22. Further, the microprocessor 20 has a brightness control port VLCD connected via an internal resistor to a voltage source $V_{DD}$. The output of the VLCD port is controllable by adjusting the resistance of the resistors R1, R2 in the resistor circuit 22 so as to allow the LCD panel 23 to display data with a desired brightness and contrast.

The foregoing patent, however, has several drawbacks. First, it needs too many I/O ports, including at least the VLCD, ALCD1, and ALCD2, for control of the LCD panel 23. Second, since ordinary IC technology is not able to fabricate the internal resistor with a precise resistance, which might have a deviation as large as twice the desired resistance, the externally connected resistors R1, R2 should be adjusted so as to match the internal resistor. This usually causes inconvenience to the downstream manufacturers who assemble the external resistors to the IC chip. Third, since the power detection means in the patented device is still turned on when it is not in use, energy is unduly wasted. Fourth, since a large bias voltage will cause the LCD waveforms to be reduced in display quality, the patent is not suitable for use on LCDs with large display panels since the pixels therein are each associated with a large capacitance. It is also not suitable for use on LCDs with a large resolution since the number of pixels is large. Fifth, the externally connected resistors not only cause an increase in component cost, but also cause an increase in chip size to the IC chips having pad limit requirements since they take up at least an additional three I/O ports. There exists, therefore, a need for a new apparatus and method for generating bias voltages which can solve the foregoing problems.

SUMMARY OF THE INVENTION

It is therefore a primary objective of the present invention to provide a bias-voltage generating apparatus which does not need a large number of I/O ports to implement so as to meet the pad limit requirements.

It is another objective of the present invention to provide a bias-voltage generating apparatus which will not waste electrical power.

It is still another objective of the present invention to provide a bias-voltage generating apparatus which allows the externally connected resistors to be matched to the internal resistor.

It is yet another objective of the present invention to provide a bias-voltage generating method which can allow the externally connected resistors to be matched to the internal resistor, eliminate the necessity of connecting external capacitors to the LCD driver, reduce the level of bias current flowing through the voltage divider when the LCD waveforms are not switched, and reduce the power consumption so that the battery can have a longer life of use.

It is still yet another objective of the present invention to provide a bias-voltage generating method which can switch the bias voltage to be a top level when the LCD waveforms are being switched from one state to another and to a bottom level otherwise for reduced power consumption during this time.

It is a still further objective of the present invention to provide a bias-voltage generating apparatus which can constantly monitor the change in the system voltage and make adjustment thereto so as to supply stable bias voltages to the LCD driver.

In accordance with the foregoing and other objectives of the present invention, a new bias-voltage generating apparatus for an LCD driver as well as a method for generating the bias voltage are provided.

One embodiment of the bias-voltage generating apparatus includes:

- a voltage divider including a plurality of resistors and at least one digitally-variable resistor for dividing a system voltage into a number of apportioned voltages serving as the bias voltages, the plurality of resistors and the digitally-variable resistor being connected in series to form a DC path through which a bias current flows;
- a system-voltage monitoring circuit for monitoring the system voltage to thereby generate a voltage-level signal indicative of the present level (herein after "current level") of the system voltage; and
- a logic circuit, in response to the voltage-level signal, for generating a control signal which adjusts the resistance of the digitally-variable resistor so as to adjust the magnitude of the bias current to allow the LCD driver to output a plurality of LCD waveforms.

Another embodiment of the bias-voltage generating apparatus is coupled to an external system to receive a system voltage and a system triggering signal therefrom. This bias-voltage generating apparatus includes:

- a voltage divider including a plurality of resistors and at least one digitally-variable resistor for dividing the system voltage into a number of apportioned voltages serving as the bias voltages, the plurality of resistors and the digitally-variable resistor being connected in series to form a DC path through which a bias current flows;
- a detection-signal generator, coupled to receive the system triggering signal from the external system, for generating a voltage-detection request signal having a first logic state indicative of a start-detection mode and a second logic state indicative of a stop-detection mode;
- a system-voltage monitoring circuit, coupled to receive the voltage-detection request signal from the detection-signal generator, for monitoring the system voltage to thereby generate a voltage-level signal indicative of the current level of the system voltage; and
- a logic circuit, in response to the voltage-level signal, for generating a control signal which adjusts the resistance of the digitally-variable resistor based on the current level of the system voltage so as to adjust the magnitude of the bias current to allow the LCD driver to output a plurality of LCD waveforms.

A still further embodiment of the bias-voltage generating apparatus includes:

- a voltage divider including a plurality of first resistors and at least one digitally-variable resistor for dividing the system voltage into a number of apportioned voltages serving as the bias voltages, the plurality of first resistors and the digitally-variable resistor being connected in series to form a DC path having a first resistance through which a bias current flows,
- a detection-signal generator, coupled to receive the system triggering signal from the external system, for generating a voltage-detection request signal having a first logic state indicative of a start-detection mode and a second logic state indicative of a stop-detection mode, a system-voltage monitoring circuit, coupled to receive the voltage-detection request signal from the detection-signal generator, for monitoring the system voltage to thereby generate a voltage-level signal indicative of the current level of the system voltage; and a logic circuit, in response to the voltage-level signal, for generating a control signal which adjusts the resistance of the digitally-variable resistor based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units each being connected across one of the first resistors in the voltage divider, each switching unit being controlled by the switching signal from the switching-signal generator;

wherein when the switching signal appears at one instant when the LCD waveforms are being switched from one state to another, each switching unit switches the equivalent resistance of the DC path through the voltage divider to a reduced level lower than the first resistance so as to raise the bias current to a top level; and when the switching signal is null, each switching unit switches the equivalent resistance of the DC path through the voltage divider back to the first resistance so as to raise the bias current to a bottom level.

The system-voltage monitoring circuit can be devised in several embodiments.

One embodiment of the system-voltage monitoring circuit includes:

a reference-voltage generator for generating a reference voltage;

a plurality of voltage dividers, coupled to the system voltage, for generating a plurality of apportioned levels of the system voltage;

a plurality of switches connecting respectively the plurality of apportioned levels of the system voltage to a common signal line;

a comparator having a negative input connected to receive the reference voltage and a positive input connected to the common signal line, the comparator generating a series of comparison signals indicative of which of specified voltage ranges within which the current level of the system voltage lies; and a control circuit, coupled to the comparator and the plurality of switches, for selectively turning on the switches so as to allow the comparator to generate the comparison signals and processing the comparison signals to thereby generate a voltage-level signal indicative of the range within which the current level of the system voltage lies.

Still another embodiment of the system-voltage monitoring circuit includes:

a reference-voltage generator for generating a reference voltage;

a voltage divider including a plurality of serially connected resistors having one end coupled to the system voltage for generating a plurality of apportioned levels of the system voltage, the voltage divider including one node serving as an output thereof;

a plurality of switches connected across the resistors in the voltage divider in a predetermined manner such that a selected number of the resistors are short-circuited when the switches are selectively turned on, allowing the output of the voltage divider to send out one apportioned level of the system voltage;

a comparator having a negative input connected to receive the reference voltage and a positive input connected to the output of the voltage divider, the comparator generating a series of comparison signals indicative of the voltage range within which the current level of the system voltage lies; and a control circuit, coupled to the comparator and the plurality of switches, for selectively turning on the switches so as to allow the comparator to generate the comparison signals and processing the comparison signals to thereby generate a voltage-level signal indicative of the range within which the current level of the system voltage lies.

Still a further embodiment of the system-voltage monitoring circuit includes:

an actuating circuit, coupled to receive the voltage-detection request signal, for generating an actuating signal; and a voltage detector, in response to the actuating signal, for detecting the current level of the system voltage and thereby generating a voltage-level signal indicative of the current level of the system voltage.

Further, the voltage detector includes:

a first MOS transistor of a first type having a source, a drain, and a gate;

a second MOS transistor of a first type having a source, a drain, and a gate;

a third MOS transistor of a second type having a source, a drain, and a gate; and a fourth MOS transistor of a second type having a source, a drain, and a gate.

In the foregoing voltage detector, the first MOS transistor has its source coupled to the system voltage, the gate coupled to the system voltage, and the drain connected to the source of the second MOS transistor; the second MOS transistor has its source connected to the drain of the first MOS transistor, the drain connected to the drain of the third MOS transistor, and the gate coupled to the system voltage; the third MOS transistor has its source coupled to receive the actuating signal from the actuating circuit, the drain connected to the drain of the second MOS transistor, and the gate coupled to the system voltage; and the fourth MOS transistor has its source connected to the drain of the second MOS transistor and the drain of the third MOS transistor, the drain connected to the drain of the first MOS transistor and the source of the second MOS transistor, and the gate coupled to the system voltage. The source of the fourth MOS transistor serves as an output to send out the voltage-level signal which indicates the current level of the system voltage. These MOS transistors can be PMOS transistors and NMOS transistors.

Furthermore, the switching circuit can be devised in various embodiments. One embodiment of the switching circuit includes a plurality of switching units each being connected across one of the first resistors in the voltage divider, each switching unit being controlled by the switching signal from the switching-signal generator. When the switching signal appears at one instant when the LCD waveforms are being switched from one state to another, each switching unit switches the equivalent resistance of the DC path through the voltage divider to a reduced level lower than the first resistance so as to raise the bias current to a top level; and when the switching signal is null, each switching unit switches the equivalent resistance of the DC path through the voltage divider back to the first resistance so as to raise the bias current to a bottom level.

Still another embodiment of the switching circuit includes a plurality of switches each being connected across one of the second resistors in the voltage divider, each switch being controlled by the switching signal from the switching-signal generator. When the switching signal appears at one instant when the LCD waveforms are being switched from one state to another, each switch is closed-circuited so as to short-circuit the second resistors, thereby switching the equivalent resistance of the DC path through the voltage divider to a reduced level so as to raise the bias current to a top level; and when the switching signal is null, each switch is open-circuited such that each second resistor is connected in series to the associated first resistor, thereby raising the equivalent resistance of the DC path through the voltage divider so as to lower the bias current to a bottom level.

A further embodiment of the switching circuit includes a plurality of switching units having an internal resistance, each switching unit each being connected across one of the first resistors in the voltage divider, each switching unit being controlled by the switching signal from the switching-signal generator. When the switching signal appears at one instant the LCD waveforms are switched from one state to another, each switching unit being switched on such that the internal resistance thereof is connected in parallel to one of the first resistors in the voltage divider such that the equivalent resistance of the DC path through the voltage divider is lowered to a reduced level lower than the first resistance so as to raise the bias current to a top level; and when the switching signal is null, the internal resistance is disconnected from the associated first resistor such that the equivalent resistance of the DC path through the voltage divider is restored back to the first resistance so as to lower the bias current to a bottom level.

Based on the foregoing various embodiments of the apparatus of the invention, different methods are provided to operate them. Each method is used to generate a set of bias voltages for an LCD driver to drive an LCD panel. The bias voltages being obtained by means of a voltage divider dividing a system voltage into a number of apportioned voltages serving as the bias voltages.

The first method includes the following steps:

(1) detecting the current level of the system voltage to thereby generating a voltage-level signal indicative of the current level of the system voltage;

(2) in response to the voltage-level signal, generating a logic control signal; and (3) applying the logic control signal to a digitally-variable resistor connected in series to the voltage divider so as to adjust the magnitude of a bias current flowing through the voltage divider, the bias current being switched to a top level when the LCD driver needs to generate a plurality of LCD waveforms to the LCD panel, and switched to a bottom level when the LCD driver is not in use.

The second method includes the following steps:

(1) in response to a system triggering signal from an external system, generating a voltage-detection request signal;

(2) determining whether the system triggering signal indicates a start-detection mode;

if yes, detecting the current level of the system voltage and thereby generating a voltage-level signal indicative of the current level of the system voltage;

(3) in response to the voltage-level signal, generating a logic control signal; and (4) applying the logic control signal to a digitally-variable resistor connected in series to the voltage divider so as to adjust the magnitude of a bias current flowing through the voltage divider, the bias current being switched to a top level when the LCD driver needs to generate a plurality of LCD waveforms to the LCD panel, and switched to a bottom level when the LCD driver is not in use.

The third method includes the following steps:

(1) in response to a system triggering signal from an external system, generating a voltage-detection request signal;

(2) determining whether the system triggering signal indicates a start-detection mode;

if yes, detecting the current level of the system voltage and thereby generating a voltage-level signal indicative of the current level of the system voltage;

(3) in response to the voltage-level signal, generating a logic control signal; and (4) applying the logic control signal to the digitally-variable resistor connected in series to the voltage divider so as to raise the magnitude of the bias current flowing through the voltage divider, allowing the generation of the bias voltages from the voltage divider;

(5) inputting the bias voltages to the LCD driver to cause the LCD driver to generate a plurality of LCD waveforms;

(6) at each instant when the LCD waveforms are being switched from one state to another, generating a switching signal; and (7) inputting the switching signal to a switching circuit including a plurality of switching units each being connected across one of the first resistors in the voltage divider, each switching unit being controlled by the switching signal;

wherein when the switching signal appears at one instant when the LCD waveforms are being switched from one state to another, each switching unit switches the equivalent resistance of the DC path through the voltage divider to a reduced level lower than the first resistance so as to raise the bias current to a top level; and when the switching signal is null, each switching unit switches the equivalent resistance of the DC path through the voltage divider back to the first resistance so as to raise the bias current to a bottom level.

The fourth method includes the following steps:

(1) in response to a system triggering signal from an external system, generating a voltage-detection request signal;

(2) determining whether the system triggering signal indicates a start-detection mode, if yes, detecting the current level of the system voltage and thereby generating a voltage-level signal indicative of the current level of the system voltage;

(3) in response to the voltage-level signal, generating a logic control signal; and (4) applying the logic control signal to the digitally-variable resistor connected in series to the voltage divider so as to raise the magnitude of the bias current flowing through the voltage divider, allowing the generation of the bias voltages from the voltage divider;

(5) inputting the bias voltages to the LCD driver to cause the LCD driver to generate a plurality of LCD waveforms;

(6) at each instant when the LCD waveforms are being switched from one state to another, generating a switching signal; and (7) inputting the switching signal to a switching circuit including a plurality of switching units having an internal resistance, each switching unit each being connected across one of the first resistors in the voltage divider, each switching unit being controlled by the switching signal;

wherein when the switching signal appears at one instant when the LCD waveforms are being switched from one state to another, each switching unit being switched on such that the internal resistance thereof is connected in parallel to one of the first resistors in the voltage divider such that the equivalent resistance of the DC path through the voltage divider is lowered to a reduced level lower than the first resistance so as to raise the bias current to a top level; and when the switching signal is null, the internal resistance is disconnected from the associated first resistor such that the equivalent resistance of the DC path through the voltage divider is restored back to the first resistance so as to lower the bias current to a bottom level.

The fifth method includes the following steps:

(1) in response to a system triggering signal from an external system, generating a voltage-detection request signal;

(2) determining whether the system triggering signal indicates a start-detection mode;

if yes, detecting the current level of the system voltage and thereby generating a voltage-level signal indicative of the current level of the system voltage;

(3) in response to the voltage-level signal, generating a logic control signal; and (4) applying the logic control signal to the digitally-variable resistor connected in series to the voltage divider so as to raise the magnitude of the bias current flowing through the voltage divider, allowing the generation of the bias voltages from the voltage divider, (5) inputting the bias voltages to the LCD driver to cause the LCD driver to generate a plurality of LCD waveforms;

(6) at each instant when the LCD waveforms are being switched from one state to another, generating a switching signal; and (7) inputting the switching signal to a switching circuit including a plurality of switches each being connected across one of the second resistors in the voltage divider, each switch being controlled by the switching signal from the switching-signal generator, wherein when the switching signal appears at one instant when the LCD waveforms are being switched from one state to another, each switch is closed-circuited so as to short-circuit the second resistors, thereby switching the equivalent resistance of the DC path through the voltage divider to a reduced level so as to raise the bias current to a top level; and when the switching signal is null, each switch is open-circuited such that each second resistor is connected in series to the associated first resistor, thereby raising the equivalent resistance of the DC path through the voltage divider so as to lower the bias current to a bottom level.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Apparatus of the Invention

Figure 1:
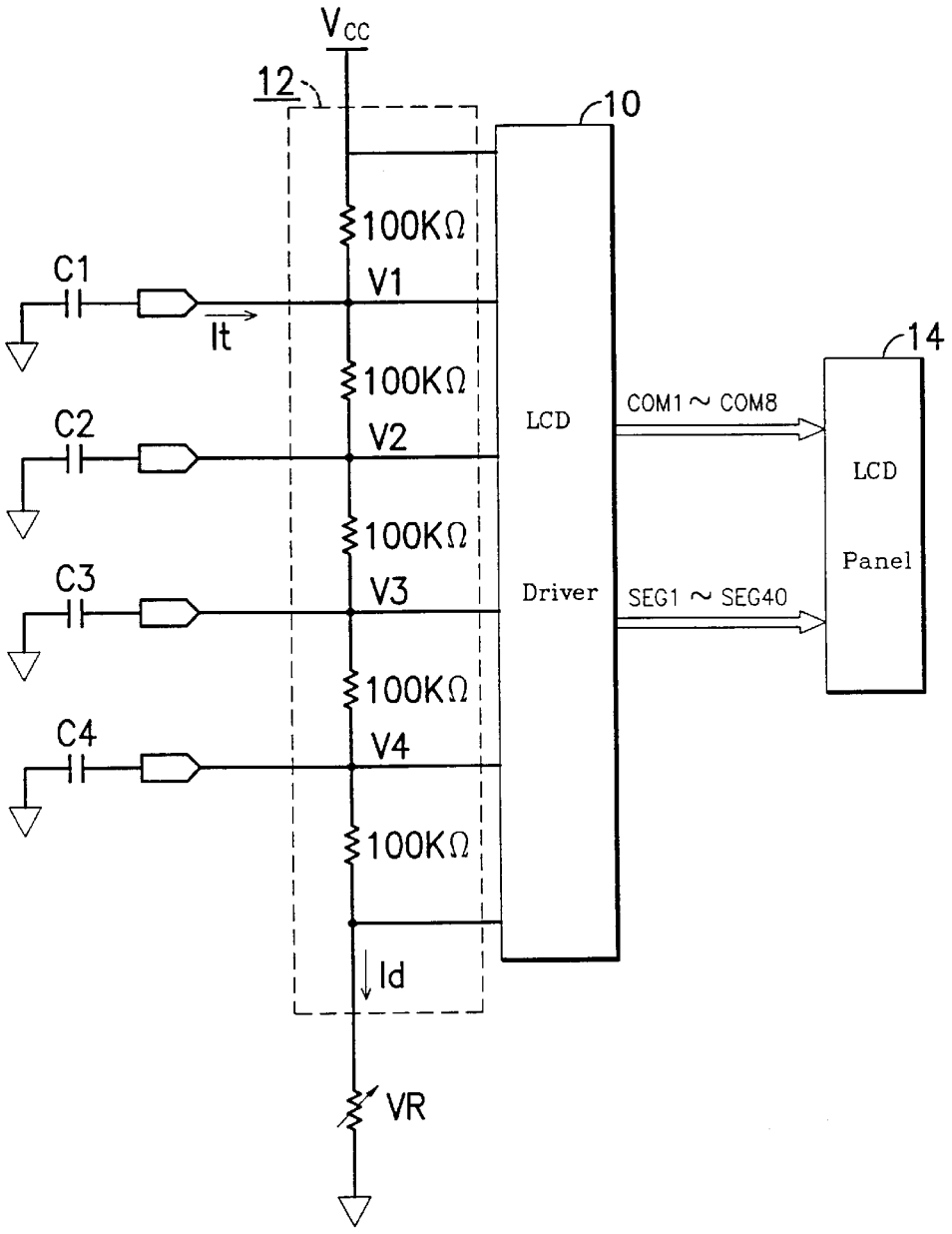
FIG. 1 (PRIOR ART)
FIG. 1 is a schematic circuit diagram of a first conventional bias-voltage generating apparatus for an LCD driver to drive an LCD panel.
Figure 2:
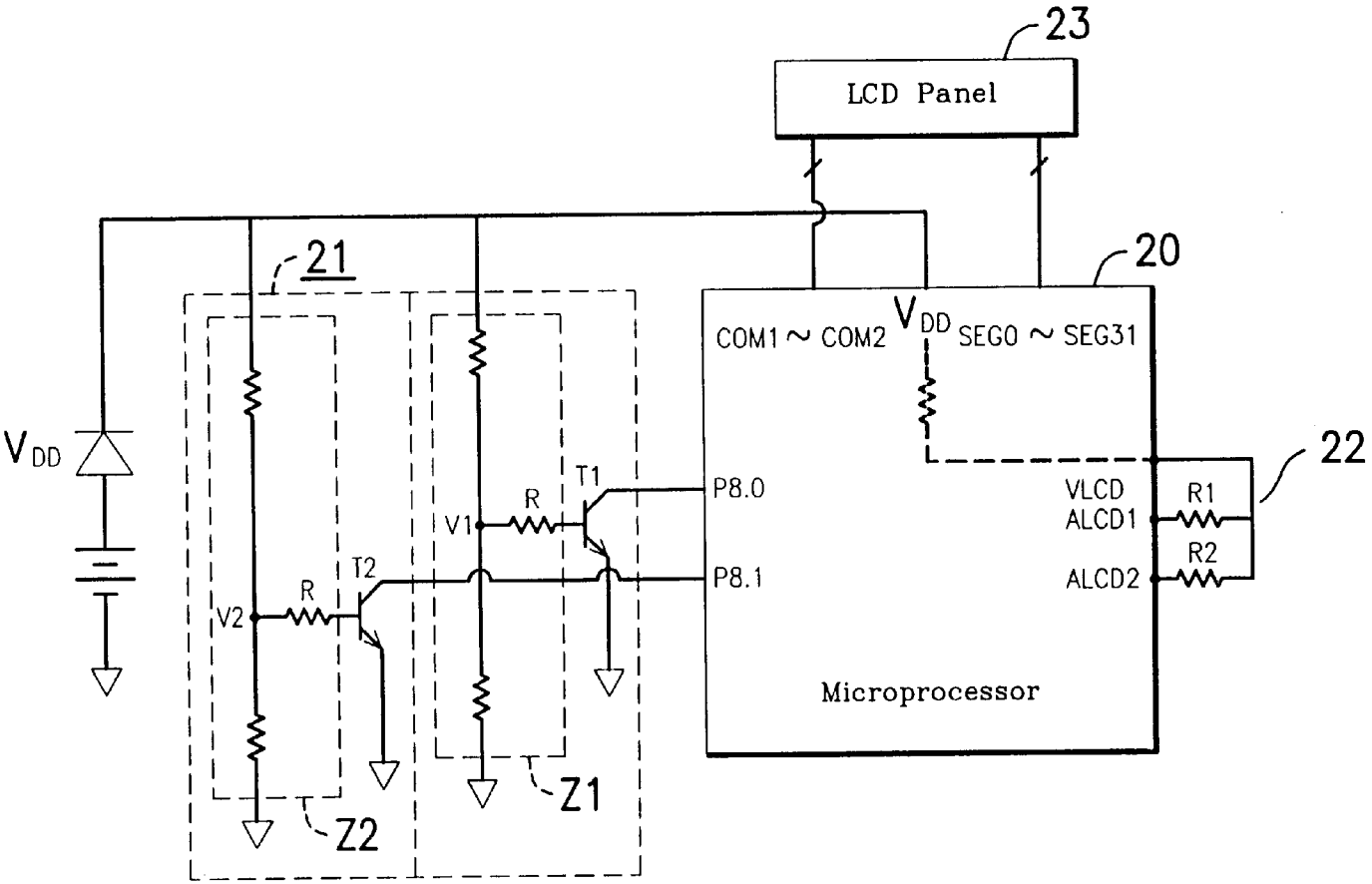
FIG. 2 (PRIOR ART)
FIG. 2 is a schematic circuit diagram of a second conventional bias-voltage generating apparatus for an LCD driver to drive an LCD panel.
Figure 3:
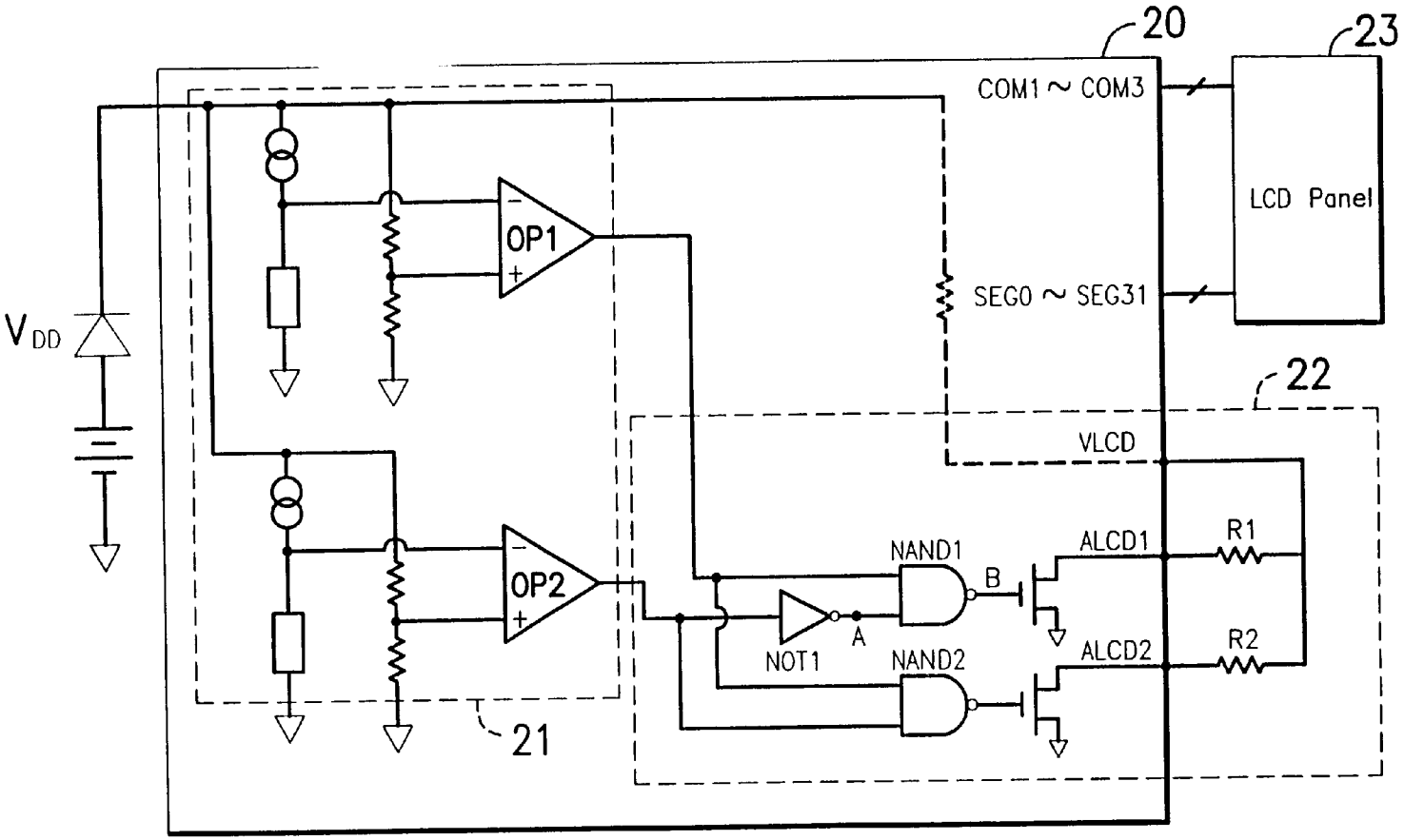
FIG. 3 (PRIOR ART)
FIG. 3 is a schematic circuit diagram of a third conventional bias-voltage generating apparatus for an LCD driver to drive an LCD panel.
Figure 4:
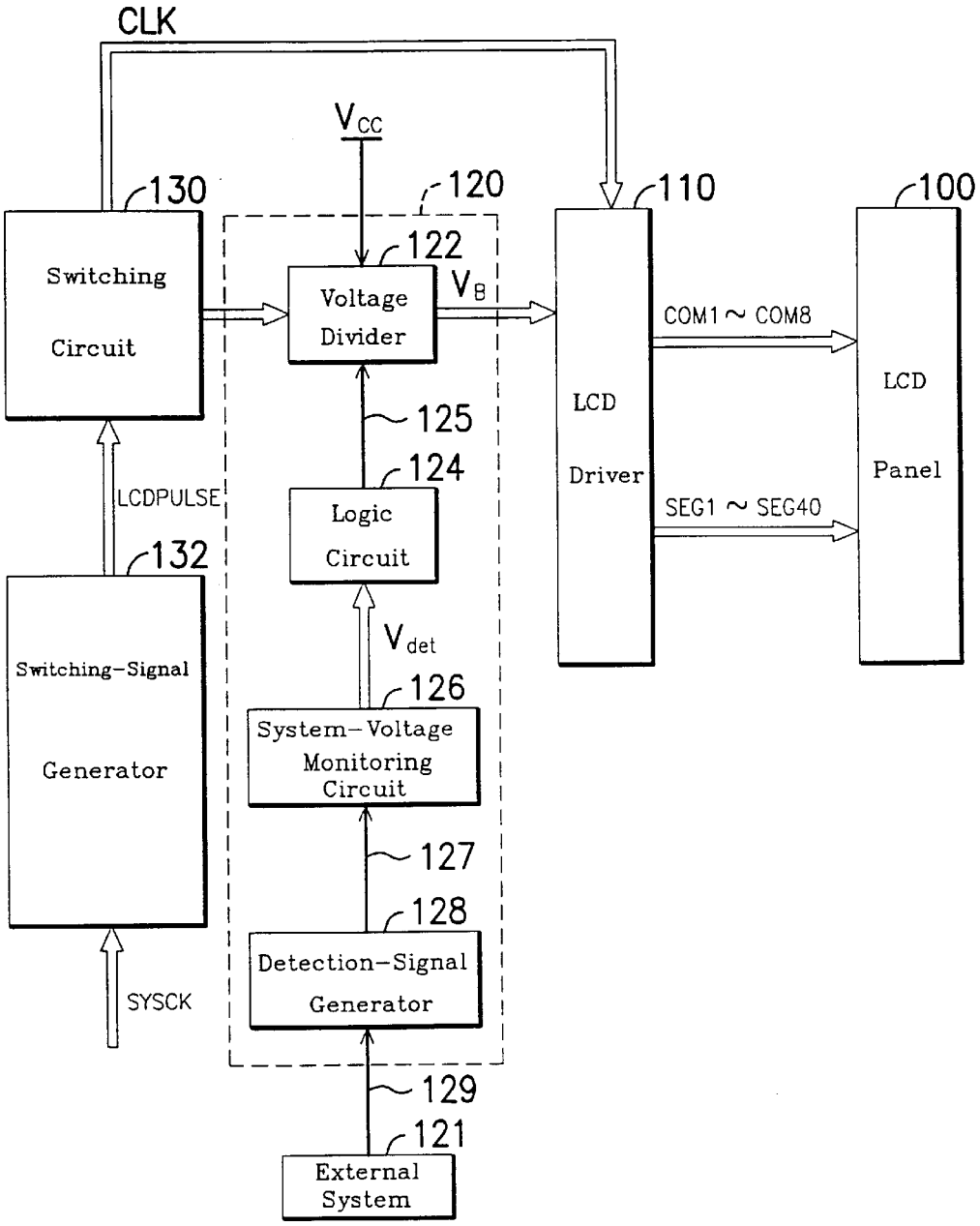
FIG. 4 is a schematic block diagram depicting the basic system architecture of the bias-voltage generating apparatus according to the present invention.

FIG. 4 is a schematic block diagram of a bias-voltage generating apparatus 120 according to the present invention, which is used in conjunction with a switching circuit 130 and a switching-signal generator 132 to provide a set of bias voltages, which are collectively designated by $V_B$, for an LCD driver 110 to drive an LCD panel 100.

The bias-voltage generating apparatus 120 includes a voltage divider 122, a logic circuit 124, a system-voltage monitoring circuit 126, and a detection-signal generator 128. The voltage divider 122 is used to divide a system voltage $V_{CC}$ into a number of apportioned levels serving as the bias-voltage set $V_B$ for the LCD driver 110 to generate a plurality of analog LCD waveforms, including, for example, eight common signals COM1–COM8 and a number of segment signals SEG1–SEG40. The LCD panel 100 can then be driven by these LCD waveforms to display the data or graphics represented by these LCD waveforms thereon.

The system-voltage monitoring circuit 126 is used to detect the current level of the system voltage $V_{CC}$ to thereby output a voltage-level signal $V_{det}$ indicative of the present level (hereinafter "current level"); and of the system voltage $V_{CC}$. In response to the voltage-level signal $V_{det}$, the logic circuit 124 will send out a control signal 125 to the voltage divider 122 so as to adjust the overall equivalent resistance of the voltage divider 122 to thereby adjust the magnitude of the bias current $I_d$ flowing through the voltage divider 122. Since the magnitude of the bias voltages $V_B$ are proportional to that of the bias current $I_d$, the bias voltages $V_B$ will be adequate to cause the LCD driver 110 to generate a plurality of LCD waveforms to drive the LCD panel 100 to display data.

The detection-signal generator 128 will send out a voltage-detection request signal 127 to the system-voltage monitoring circuit 126 when, for example, the power is just turned on such that a system triggering signal 129 is generated by the external system 121. If the system triggering signal 129 indicates a start-detection mode, the detection-signal generator 128 will issue the voltage-detection request signal 127 to command the system-voltage monitoring circuit 126 to start detecting the current level of the system voltage $V_{CC}$; otherwise, if the system triggering signal 129 indicates a stop-detection mode, the detection-signal generator 128 will disable the system-voltage monitoring circuit 126, allowing the system-voltage monitoring circuit 126 not to consume power when it is not in use.

The switching circuit 130 is under control by a switching signal LCDPULSE from the switching-signal generator 132 to adjust the overall equivalent resistance of the voltage divider 122 by means of switching the connections of a plurality of resistors in the voltage divider 122 so as to switch the bias current flowing through the voltage divider 122 between a top level and a bottom level. With the bias current being at the top level, the bias voltages $V_B$ are also at a high level to cause the LCD driver 110 to generate the LCD waveforms to drive the LCD panel 100.

The foregoing are only a brief description of the basic system architecture of the bias-voltage generating apparatus according to the present invention. The constituent blocks of the bias-voltage generating apparatus of FIG. 4 can be embodied in various ways, which will be disclosed in full detail in the following.

First Preferred Embodiment

Figure 5:
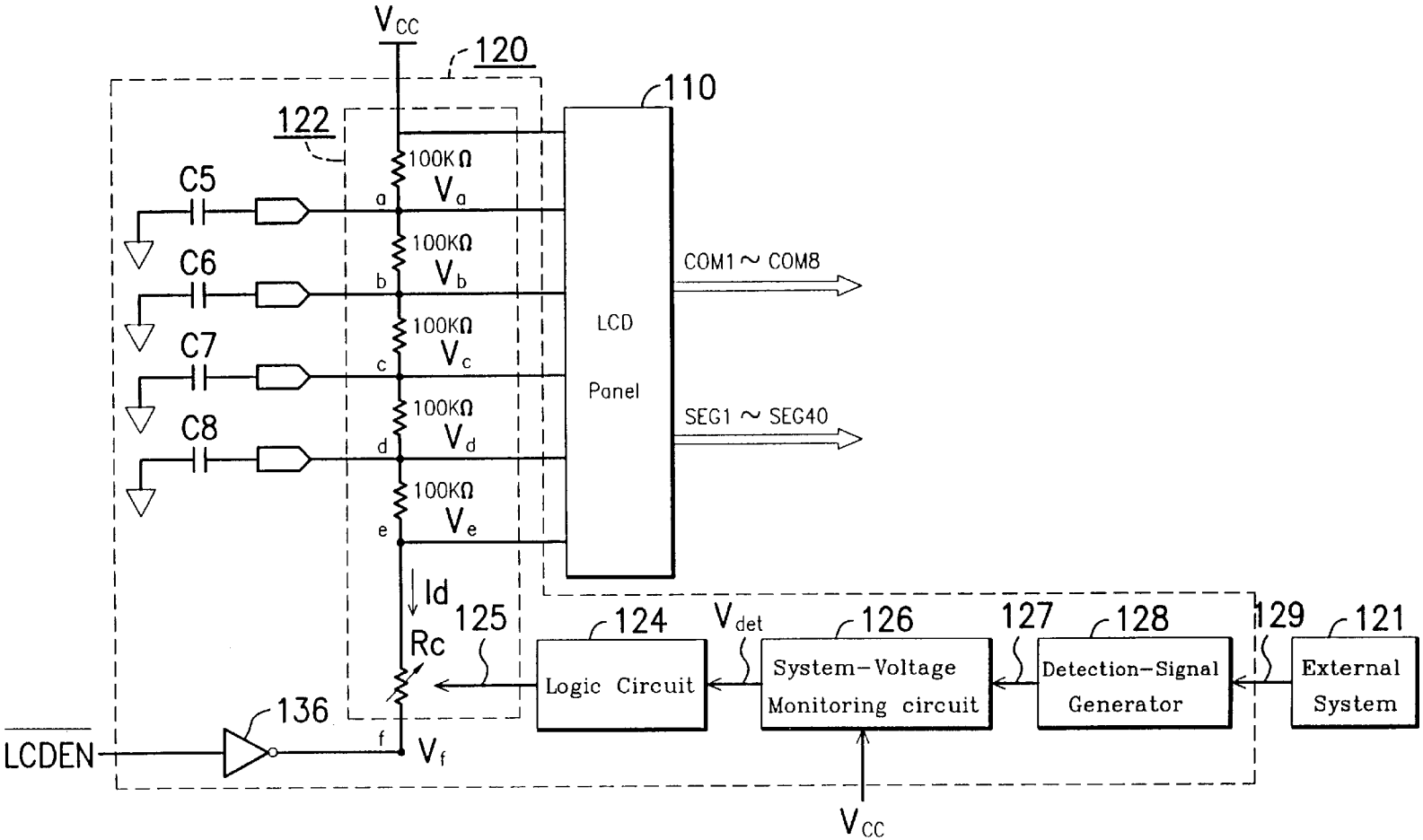
FIG. 5 is a schematic circuit diagram of a first preferred embodiment of the bias-voltage generating apparatus of the invention.

Referring to FIG. 5, there is shown a schematic circuit diagram of a first preferred embodiment of the bias-voltage generating apparatus of the invention. As shown, the voltage divider 122 is composed of five 100 kΩ resistors and one digitally-variable resistor Rc which are interconnected in series at five nodes a, b, c, d, and e. The four nodes a, b, c, d are respectively connected to a number of capacitors [C5, C6, C7, C8]. Further, the digitally-variable resistor Rc is connected via a node f to the output of an inverter 136 which receives an enable signal named LCDEN. The potentials at the nodes a, b, c, d, e, and f are respectively designated by $V_a$, $V_b$, $V_c$, $V_d$, $V_e$, and $V_f$, of which the five potentials [$V_a$, $V_b$, $V_c$, $V_d$, $V_e$] serve as the bias voltage set $V_B$ for the LCD driver 110. The resistance of the digitally-variable resistor Rc is adjustably controlled by the output of the logic circuit 124. The equivalent resistance $R_{eq}$ of the serially connected 100 kΩ resistors and the digitally-variable resistor Rc in the voltage divider 122 determines the magnitude of the bias current $I_d$ flowing through these resistors, and thus the magnitude of the bias voltages [$V_a$, $V_b$, $V_c$, $V_d$, $V_e$].

The detection-signal generator 128 will send out a voltage-detection request signal 127 to the system-voltage monitoring circuit 126 when, for example, the power is just turned on such that a system triggering signal 129 is generated by the external system 121. If the system triggering signal 129 indicates a start-detection mode, the detection-signal generator 128 will command the system-voltage monitoring circuit 126 to start detecting the current level of the system voltage $V_{CC}$; otherwise, if it indicates a stop-detection mode, the detection-signal generator 128 will disable the system-voltage monitoring circuit 126, thus allowing the system-voltage monitoring circuit 126 not to consume power when it is not in use.

The system-voltage monitoring circuit 126 is devised in particular to detect the current level of the system voltage $V_{CC}$ in response to the voltage-detection request signal 127 from the detection-signal generator 128 to thereby generate a voltage-level signal $V_{det}$ indicative of the current level of the system voltage $V_{CC}$. In response to the voltage-level signal $V_{det}$, the logic circuit 124 will send out a control signal 125 which can adjust the resistance of the digitally-variable resistor Rc to a prescribed value according to the current level of the system voltage $V_{CC}$. The change of Rc will then change the equivalent resistance $R_{eq}$ of the voltage divider 122, thereby allowing for an adequate magnitude for the bias voltages [$V_a$, $V_b$, $V_c$, $V_d$, $V_e$] to cause the LCD driver 110 to generate the LCD waveforms.

Further, since the use of the 100 kΩ resistors (which are relatively high in resistance) will cause the dynamic current supply to be low, the provision of the capacitors [C5, C6, C7, C8 ] can allow for a large magnitude for the bias current at the instance the LCD waveforms are being switched from one state to another.

The enable signal $\overline{\text{LCDEN}}$ is used to control the state of the potential $V_f$ at the node f in a manner given in the following Table 1

TABLE 1

| $\overline{\text{LCDEN}}$ = 1, $V_f$ = 0 | $\overline{\text{LCDEN}}$ = 0, $V_f$ = 1 |
|---|---|
| $Va = \frac{400K + Rc}{500K + Rc} \cdot Vcc$ | Va = Vcc |
| $Vb = \frac{300K + Rc}{500K + Rc} \cdot Vcc$ | Vb = Vcc |
| $Vc = \frac{200K + Rc}{500K + Rc} \cdot Vcc$ | Vc = Vcc |
| $Vd = \frac{100K + Rc}{500K + Rc} \cdot Vcc$ | Vd = Vcc |

The foregoing Table 1 shows that, when $\overline{\text{LCDEN}}$=0, it will be inverted by the inverter 136 to a logic-1 state, thus causing the potential $V_f$ at the node f to be set at a logic-1 voltage state which is equal to $V_{CC}$, thus serving as a counterbalancing potential to the system voltage $V_{CC}$ on the opposite side of the voltage divider 122. As a result of this, no current will flow through the voltage divider 122. On the other hand, when the bias-voltage generating apparatus 120 needs a large magnitude for the bias current $I_d$, the enable signal $\overline{\text{LCDEN}}$ is switched to a logic-1 voltage state.

When $\overline{\text{LCDEN}}$=1, the bias voltages [$V_a$, $V_b$, $V_c$, $V_d$, $V_e$] are fed to the LCD driver 110 to cause the LCD driver 110 to output the common signals COM1–COM8 and segment signals SEG1–SEG40. When $\overline{\text{LCDEN}}$=0, all the bias voltages [$V_a$, $V_b$, $V_c$, $V_d$, $V_e$] are switched to a magnitude equal to $V_{CC}$.

Second Preferred Embodiment

Figure 6:
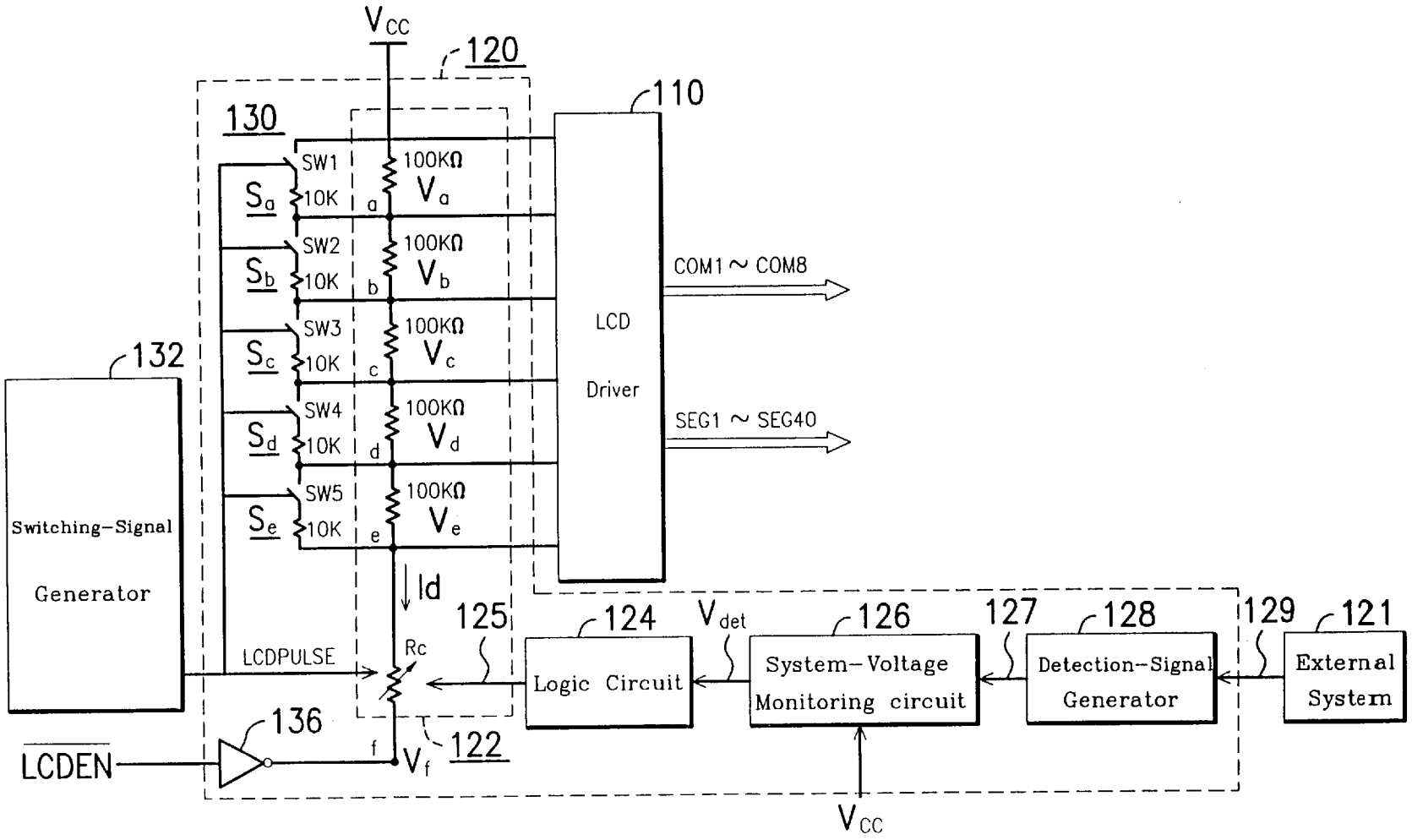
FIG. 6 is a schematic circuit diagram of a second preferred embodiment of the bias-voltage generating apparatus of the invention.

Referring to FIG. 6, there is shown a schematic circuit diagram of a second preferred embodiment of the bias-voltage generating apparatus of the invention. In FIG. 6, elements that are identical to those in the previous embodiment of FIG. 5 are labeled with the same reference numerals.

This embodiment differs from the previous one particularly in that a switching circuit 130 and a switching-signal generator 132 are coupled to the voltage divider 122. The switching circuit 130 is composed of a number of switching units [$S_a$, $S_b$, $S_c$, $S_d$, $S_e$] each consisting of one 10 kΩ resistor and one switch, respectively designated by SW1, SW2, SW3, SW4, and SW5. These switching units [$S_a$, $S_b$, $S_c$, $S_d$, $S_e$] are each connected across one of the 100 kΩ resistors in the voltage divider 122.

The ON/OFF state of each of these switching units [$S_a$, $S_b$, $S_c$, $S_d$, $S_e$] is controlled by the switching signal LCDPULSE generated by the switching-signal generator 132. For instance, at the instant when the LCD waveforms are being switched from one state to another, it will cause LCDPULSE=1. The appearance of LCDPULSE=1 will then turn on all of the switches [SW1, SW2, SW3, SW4, SW5 ] to a closed-circuited state, such that the 10 kΩ resistors in the switching circuit 130 are respectively connected in parallel to the 100 kΩ resistors in the voltage divider 122, resulting in an equivalent resistance of 9.09 kΩ between each neighboring pair of the nodes a, b, c, d, and e. As a result of this, the bias current $I_d$ flowing through the voltage divider 122 is increased to a top level.

On the other hand, during the time when the LCD waveforms are at steady states, the switching-signal generator 132 will output LCDPULSE=0, which will turn off all of the switches [SW1, SW2, SW3, SW4, SW5 ] to an open-circuited state. As a result of this, all the 10 kΩ resistors are disconnected from the associated 100 kΩ resistors in the voltage divider 122. This causes the resistance between each neighboring pair of the nodes a, b, c, d, and e to be switched from 9.09 kΩ back to 100 kΩ. As a result of this, the bias current $I_d$ flowing through the voltage divider 122 is increased to a bottom level. For example, if $V_{CC}$=5 V, $I_d$=5V/(100×5) kΩ=10 μA, which is a substantially negligible low current.

Third Preferred Embodiment

Figure 7:
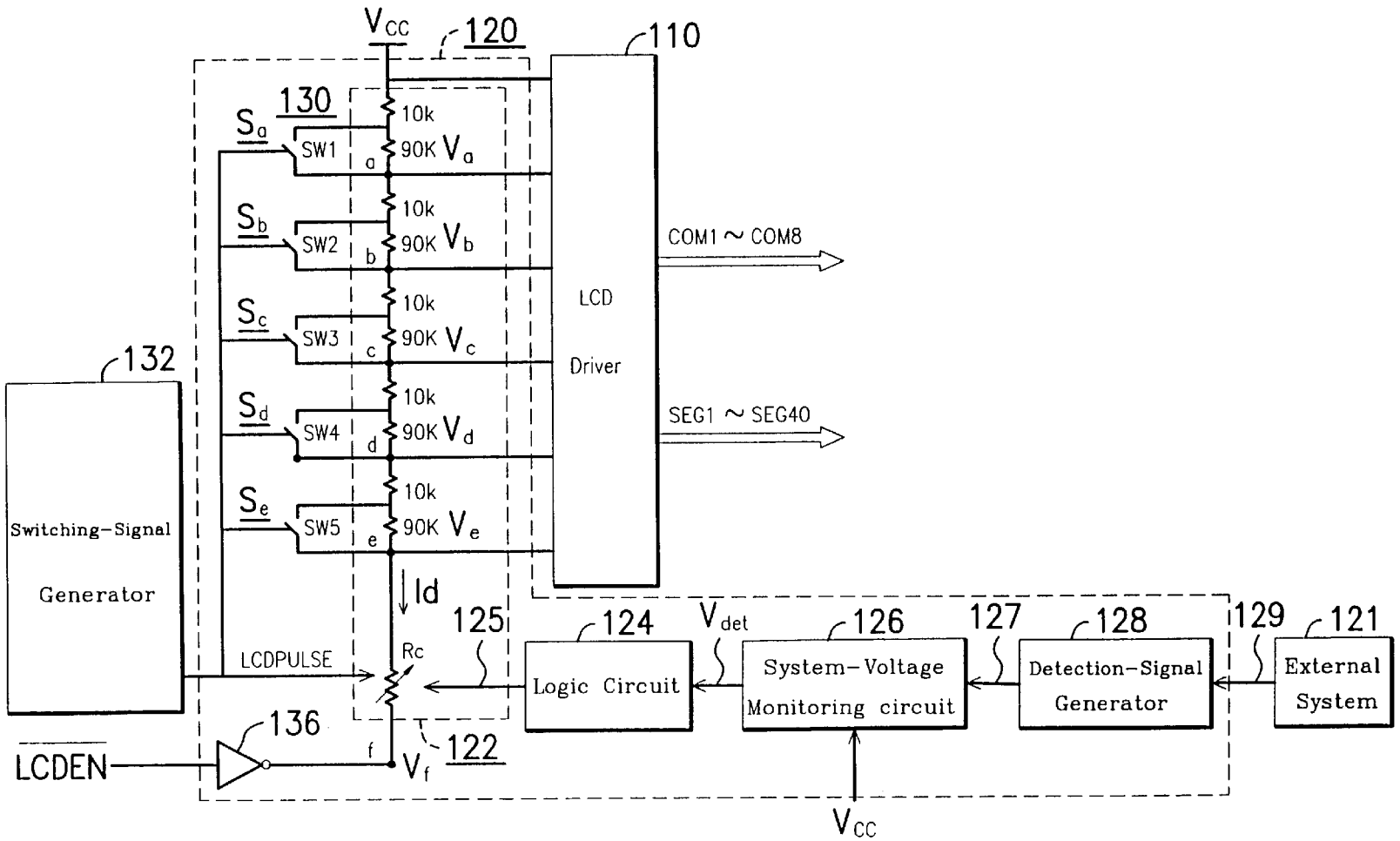
FIG. 7 is a schematic circuit diagram of a third preferred embodiment of the bias-voltage generating apparatus of the invention.

Referring to FIG. 7, there is shown a schematic circuit diagram of a third preferred embodiment of the bias-voltage generating apparatus of the invention. In FIG. 7, elements that are identical to those in the previous embodiment of FIG. 5 are labeled with the same reference numerals.

This embodiment differs from the previous one of FIG. 6 particularly in that, in the voltage divider 122, the 100 kΩ resistors in the previous embodiment are here replaced with 10 kΩ resistors, and the switching units [$S_a$, $S_b$, $S_c$, $S_d$, $S_e$] is each composed of a 90 kΩ resistor connected in series to one of these 90 kΩ resistors and a switch, respectively SW1, SW2, SW3, SW4, and SW5, connected across the 90 kΩ.

At the instant when the LCD waveforms are being switched from one state to another, the switching-signal generator 132 will be triggered to output LCDPULSE=1, which turns on all of the switches [SW1, SW2, SW3, SW4, SW5 ] to a closed-circuited state, thus short-circuiting all of the 90 kΩ resistors in the voltage divider 122. The equivalent resistance of the voltage divider 122 is thus 5×10 kΩ=50 kΩ. The bias current $I_d$ is thus switched to a top level that will cause the LCD driver 110 to generate adequate LCD waveforms to the LCD driver 110.

On the other hand, when the LCD waveforms are at steady states, the switching-signal generator 132 will output LCDPULSE=0 to the switching circuit 130, thus turning off all of the switches [SW1, SW2, SW3, SW4, SW5 ] to an open-circuited state. This effectively connects the 90 kΩ resistors respectively in series to the 10 kΩ resistors. As a result, the resistance between each neighboring pair of the nodes a, b, c, d, and e becomes 10+90=100 kΩ. The equivalent resistance of the voltage divider 122 is thus 5×100 kΩ=500 kΩ. Therefore, the bias current $I_d$ is switched to a bottom state that allows for a reduce power consumption.

Fourth Preferred Embodiment

Figure 8A:
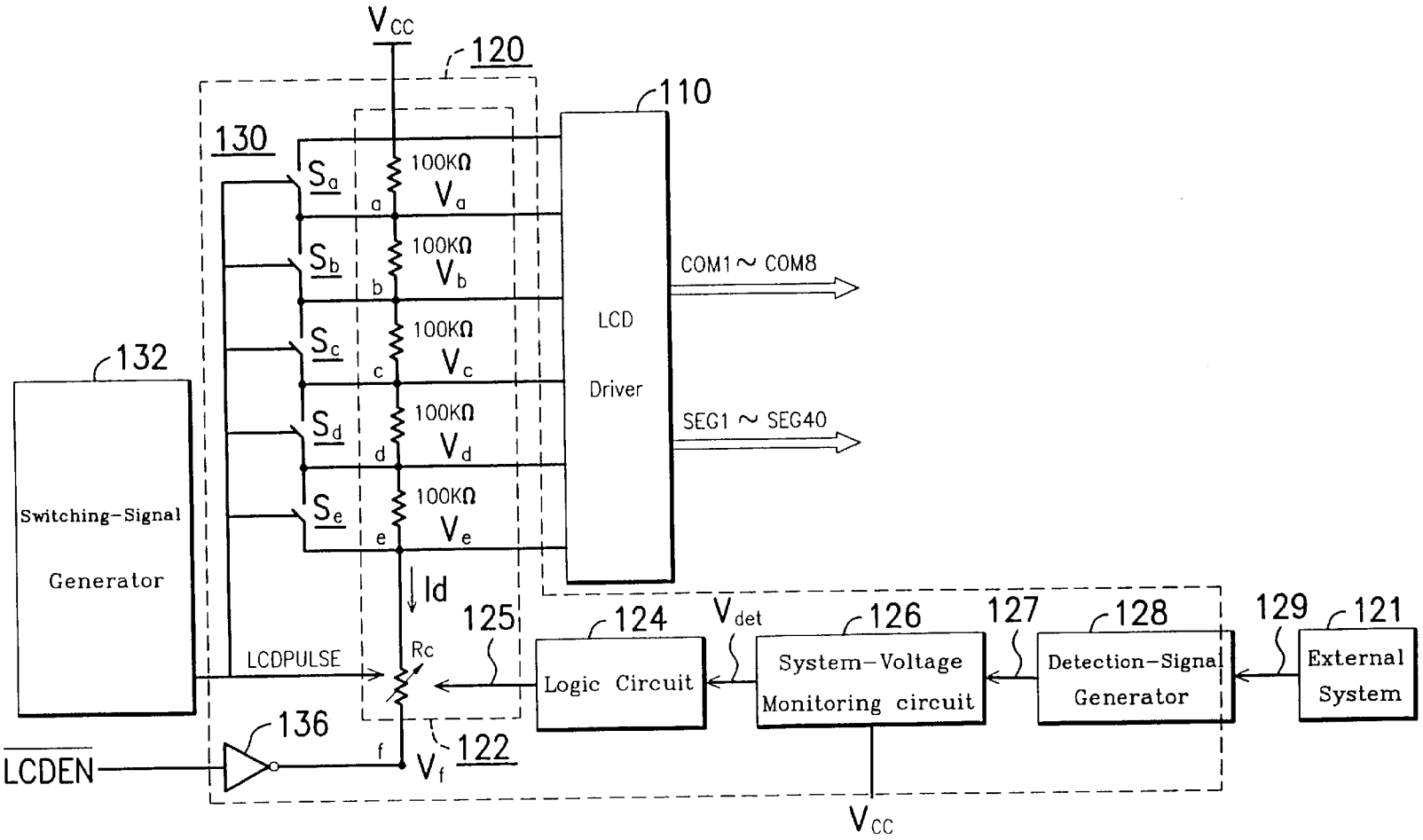
FIG. 8A is a schematic circuit diagram of a fourth preferred embodiment of the bias-voltage generating apparatus of the invention.
Figure 8B:
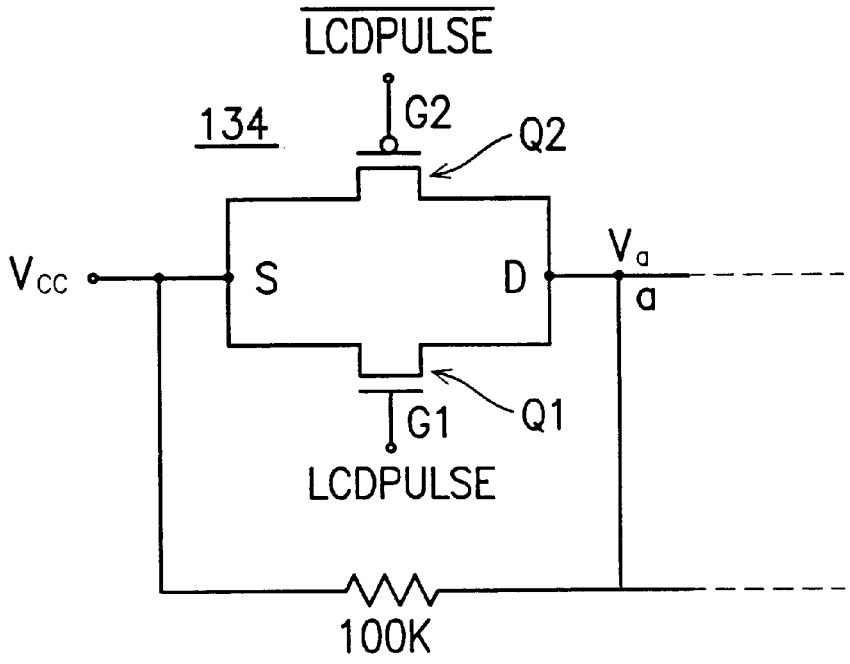
FIG. 8B is a detailed circuit diagram of a switch having an internal resistance employed in the bias-voltage generating apparatus of FIG. 8A.
Figure 8C:
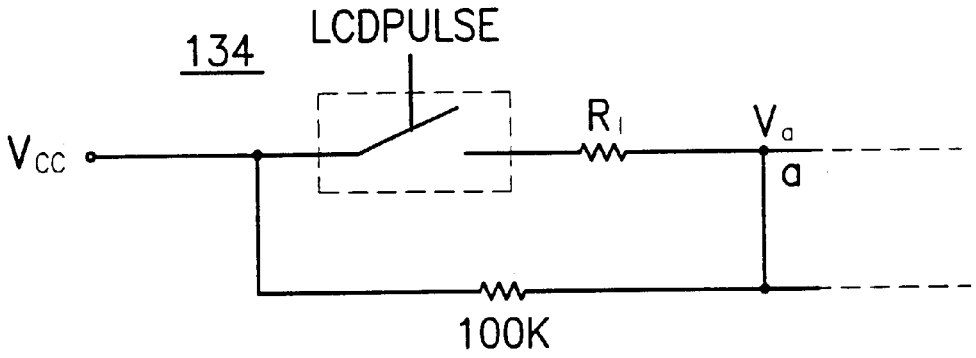
FIG. 8C is an equivalent circuit diagram of the switch of FIG. 8B.

FIGS. 8A through 8C are schematic circuit diagrams of a fourth preferred embodiment of the bias-voltage generating apparatus of the invention. In these diagrams, elements that are identical to those in the previous embodiments are labeled with the same reference numerals.

This embodiment is essentially similar to the previous embodiment of FIG. 6 except that the switching units [$S_a$, $S_b$, $S_c$, $S_d$, $S_e$] here are each of the type having an internal resistance $R_I$ (where RI is lower in resistance than the associated 100 kΩ resistors) so that the 10 kΩ resistors in the previous embodiment of FIG. 6 can be eliminated. As shown in FIG. 8A, each of the switching units [$S_a$, $S_b$, $S_c$, $S_d$, $S_e$] is connected across one of the 100 kΩ resistors in the voltage divider 122. When each of the switching unit [$S_a$, $S_b$, $S_c$, $S_d$, $S_e$] is closed-circuited, its internal resistance is effectively connected in parallel with one of the 100 kΩ resistors so that the equivalent resistance of each neighboring pair of the nodes a, b, c, d, and e is lowered. As a result of this, the bias current $I_d$ flowing through he voltage divider 122 is raised to a top level, causing the LCD driver 110 to generate the LCD waveforms.

Referring further to FIG. 8B, there is shown a detailed circuit diagram of each of the switches [$S_a$, $S_b$, $S_c$, $S_d$, $S_e$] shown in FIG. 8A. The equivalent circuit diagram of the switch of FIG. 8B is further shown in FIG. 8C.

As shown in FIG. 8B, each of the switches [$S_a$, $S_b$, $S_c$, $S_d$, $S_e$] includes a long-channel transmission gate 134 consisting of an NMOS (N-type metal-oxide semiconductor) transistor Q1 and a PMOS (P-type MOS) transistor Q2. The NMOS transistor Q1 has a gate G1 connected to the signal LCDPULSE, while the PMOS transistor Q2 has a gate G2 connected to the inverted signal $\overline{\text{LCDPULSE}}$. The source of the NMOS transistor Q1 and the source of the NMOS transistor Q1 are connected to a common node S connected further to the system voltage $V_{CC}$; and the drains of the same are connected to a common node D connected further to one of the nodes a, b, c, d, and e in the voltage divider 122 (FIG. 8A). The transmission gate 134 is connected across one of the 100 kΩ resistors in the voltage divider 122 (FIG. 8A).

At the instant when the LCD waveforms are being switched from one state to another, the switching-signal generator 132 (FIG. 8A) will be triggered to output LCDPULSE=1 to each of the switches [$S_a$, $S_b$, $S_c$, $S_d$, $S_e$], switching both of the NMOS transistor Q1 and the PMOS transistor Q2 to a conductive state, effectively connecting the internal resistance $R_I$ of the transmission gate 134 in parallel to each one of the 100 kΩ resistors. The equivalent resistance of the voltage divider 122 is thus lowered, causing the bias current $I_d$ to be switched to a top level.

Otherwise, the switching-signal generator 132 will output LCDPULSE=0 to each of the switches [$S_a$, $S_b$, $S_c$, $S_d$, $S_e$], switching both of the NMOS transistor Q1 and the PMOS transistor Q2 to a non-conductive state. This causes the resistance between each neighboring pair of the nodes a, b, c, d, and e to be switched back to 100 kΩ. The equivalent resistance of the voltage divider 122 is thus 5×100 kΩ=500 kΩ, which causes the bias current $I_d$ to be reduced from the top level to a bottom level for the purpose of reducing power consumption.

Fifth Preferred Embodiment

Figure 9:
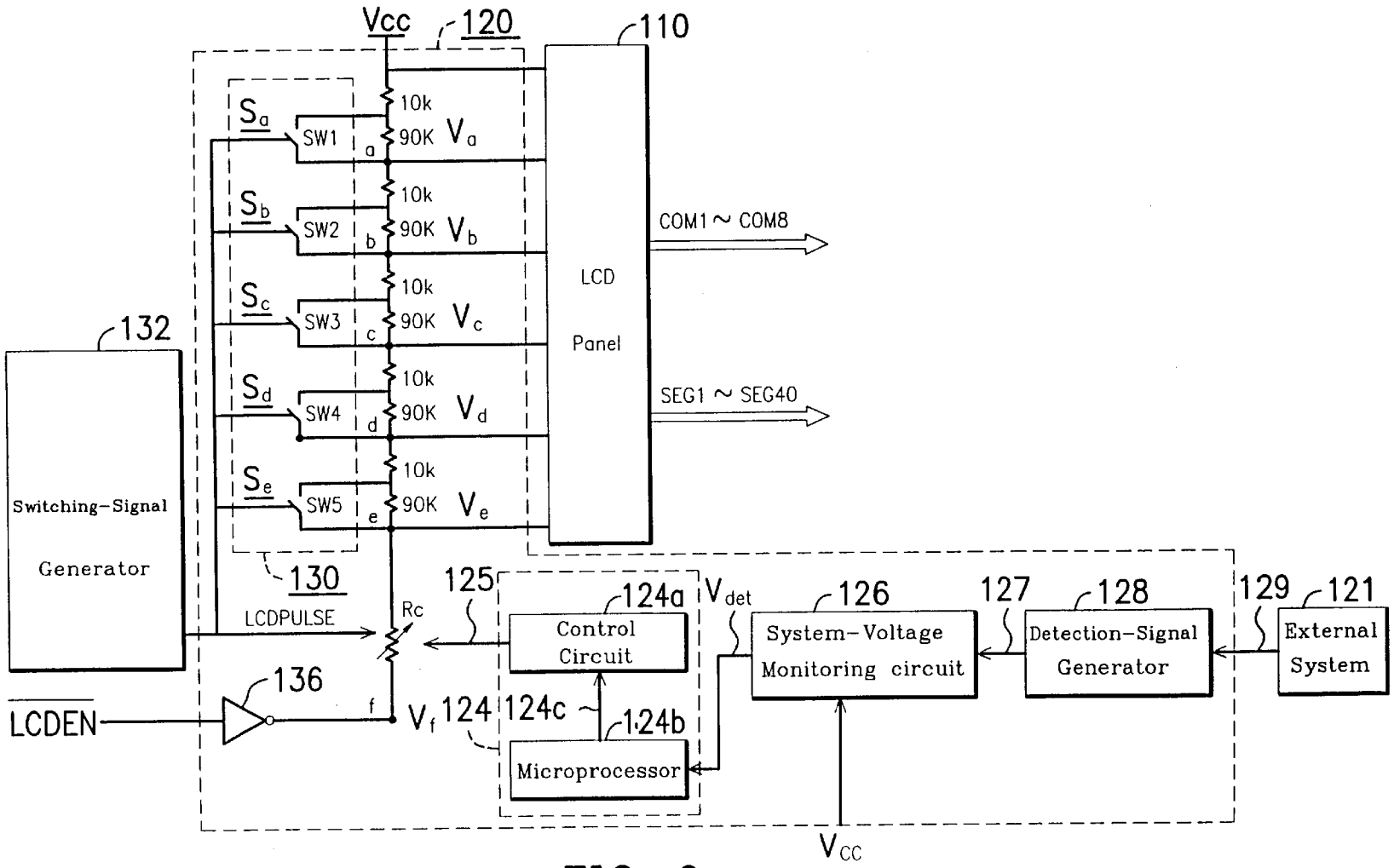
FIG. 9 is a schematic circuit diagram of a fifth preferred embodiment of the bias-voltage generating apparatus of the invention

Referring to FIG. 9, there is shown a schematic circuit diagram of a fifth preferred embodiment of the bias-voltage generating apparatus of the invention. In FIG. 9, elements that are identical to those in the previous embodiments are labeled with the same reference numerals, which are also the same in function so that description thereof will not be repeated herein.

In this embodiment, the logic circuit 124 is composed of a control circuit 124*a* and a microprocessor 124*b*. The voltage-level signal $V_{det}$ generated by the system-voltage monitoring circuit 126 is received by the microprocessor 124*b*. Based on the voltage-level signal $V_{det}$ which indicates the current level of the system voltage $V_{CC}$, the microprocessor 124*b* can output a corresponding command signal 124*c* to the control circuit 124*a*. In response to the command signal 124*c*, the control circuit 124*a* will output a control signal 125 to the digitally-variable resistor Rc to adjust the resistance of the same to a prescribed value according to the current level of the system voltage $V_{CC}$.

Figure 10:
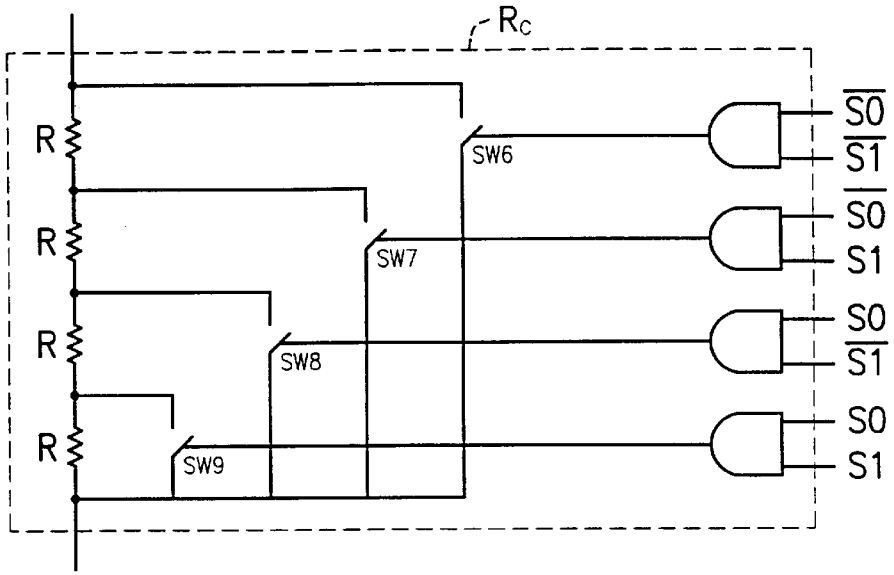
FIG. 10 is a detailed circuit diagram of a digitally-variable resistor employed in the bias-voltage generating apparatus of the invention.

Referring further to FIG. 10, there is shown the detailed circuit diagram of the digitally-variable resistor Rc. This digitally-variable resistor Rc includes four serially connected resistors of an equal resistance R. Further, a first switch SW6 is connected across all of the four resistors; a second switch SW7 is connected across the bottom three of the four resistors; a third switch SW8 is connected across the bottom two of the four resistors; and a fourth switch SW9 is connected across the bottom-most one of the four resistors.

The ON/OFF states of the switches [SW6, SW7, SW8, SW9 ] are such that when a logic signal of 1 is applied thereto, they are switched on to a closed-circuited state; and when a logic signal of 0 is applied thereto, they are switched off to an open-circuited state. The four switches [SW6, SW7, SW8, SW9 ] are connected to four AND gates and controlled by a control signal consisting of two digits [S0, S1]. The value of the control signal [S0, S1] corresponds to the range in which the current level of the system voltage $V_{CC}$ lies. The output resistance of the digitally-variable resistor Rc corresponding to the value of [S0, S1] is given in the following Table 2.

TABLE 2

| S1 | S0 | ON/OFF state of SW6, SW7, SW8, SW9 | Output Resistance of $R_c$ |
|---|---|---|---|
| 0 | 0 | SW6 ON (others are OFF) | 0 |
| 0 | 1 | SW7 ON (others are OFF) | R |
| 1 | 0 | SW8 ON (others are OFF) | 2R |
| 1 | 1 | SW9 ON (others are OFF) | 3R |

Figure 11:
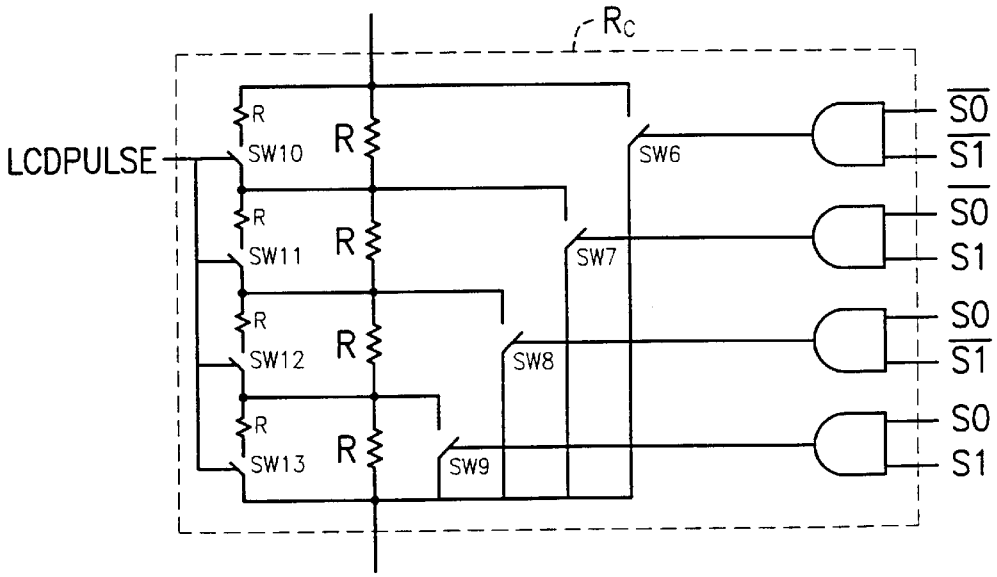
FIG. 11 is a detailed circuit diagram of a variation of the digitally-variable resistor employed in the bias-voltage generating apparatus of the invention.

Referring further to FIG. 11, there is shown a detailed circuit diagram of a variation of the digitally-variable resistor. This digitally-variable resistor differs from the previous one shown in FIG. 10 in that an additional array of switches [SW10, SW11, SW12, SW13 ], each being connected in series with a resistor of the same resistance R, are connected respectively across one of the four resistors R. The ON/OFF states of these switches [SW10, SW11, SW12, SW13 ] are together controlled by the switching signal LCDPULSE.

When LCDPULSE=1, it causes all of the switches [SW10, SW11, SW12, SW13 ] to be closed-circuited, thus forming a pair of parallel connected resistors R between each two neighboring nodes. The resistance between each two neighboring nodes is thus reduced to R/2. This allows for a wider range for the output resistance Rc of the digitally-variable resistor.

Figure 12:
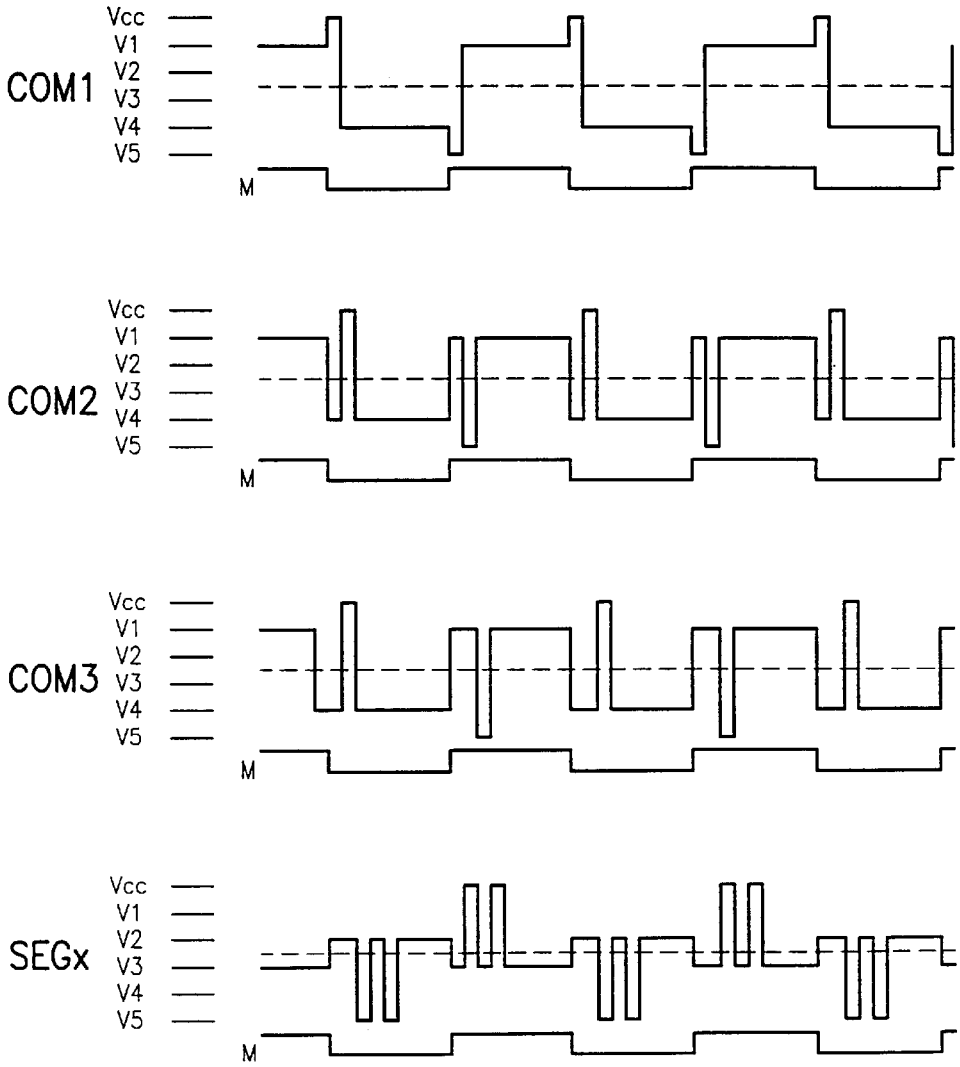
FIG. 12 is a number of signal diagrams of some of the LCD waveforms generated by the LCD driver to drive the LCD panel.

Referring to FIG. 12, there is shown a number of signal diagrams of the LCD waveforms COM1, COM2, COM3 and SEGx generated by the LCD driver. These LCD waveforms are typical waveforms used to drive the LCD panel and are illustrated here for demonstrative purpose and not related to the spirit and scope of the invention. The invention is particularly useful in minimizing the spikes in these LCD waveforms at the instant when these LCD waveforms are being switched from one state to another. This is achieved by means of dynamically reducing the overall equivalent resistance of the voltage divider 122 to thereby increase the bias current $I_d$ flowing through the voltage divider 122 to a top level. At other times, the overall equivalent resistance of the voltage divider 122 is increased so as to thereby decrease the bias current $I_d$ flowing through the voltage divider 122 to a bottom level that allows for reduced power consumption.

Figure 13:
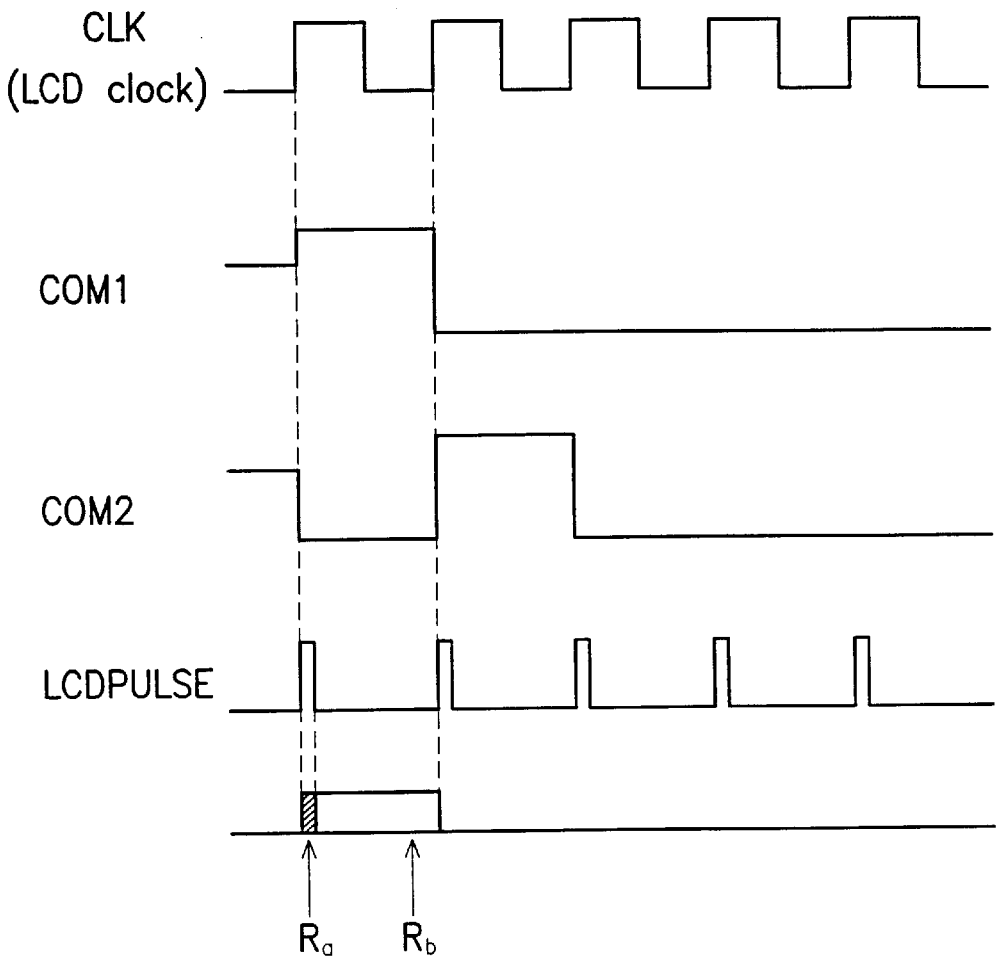
FIG. 13 is a number of signal diagrams depicting the timing of a switching signal generated at the instant when the LCD waveforms are being switched from one state to another.

Referring to FIG. 13, there is shown the signal diagrams of CLK, COM1, COM2, and LCDPULSE which are used particularly to depict the generation of the switching signal LCDPULSE at the instant when the LCD waveforms are being switched from one state to another. The CLK signal is an LCD clock generated by the switching-signal generator 132 based on the system clock SYSCK.

Each time the COM1 and COM2 waveforms are being switched from one state to another, it causes the switching-signal generator 132 to output one pulse, thus causing LCDPULSE=1. As described earlier, the appearance of LCDPULSE=1 causes all of the switches [SW1, SW2, SW3, SW4, SW5] to be closed-circuited, resulting in a low resistance (represented by $R_a$ in FIG. 13) between each neighboring pair of the nodes a, b, c, d, and e in the voltage divider 122. The overall equivalent resistance of the voltage divider 122 is thus lowered, causing the bias current $I_d$ to be increased to a top level so as to power the switching of the COM1 and COM2 waveforms to the other state.

On the other hand, when the COM1 and COM2 waveforms are at steady states, it will cause LCDPULSE=0. This will switch all of the switches [SW1, SW2, SW3, SW4, SW5] to the open-circuited state, thus resulting in a high resistance (represented by $R_b$ in FIG. 13) between each neighboring pair of the nodes a, b, c, d, and e in the voltage divider 122. The overall equivalent resistance of the voltage divider 122 to is thus raised. This causes the bias current $I_d$ to be lowered to a bottom level that allows for reduced power consumption to save energy.

Figure 14:
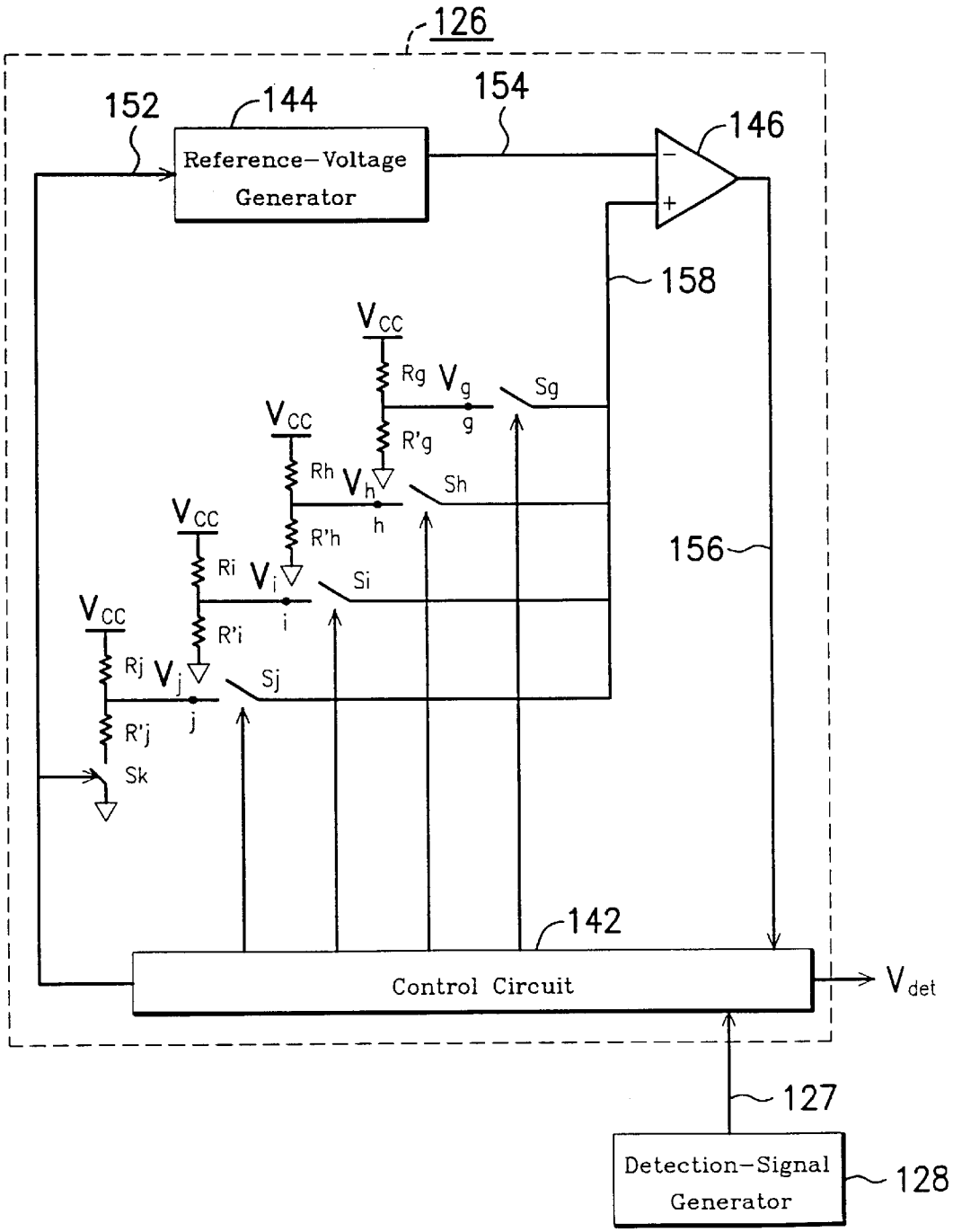
FIG. 14 is a detailed circuit diagram of a system-voltage monitoring circuit employed in the bias-voltage generating apparatus of the invention.

Referring to FIG. 14, there is shown a detailed circuit diagram of the system-voltage monitoring circuit 126. As shown, the system-voltage monitoring circuit 126 includes a control circuit 142, a comparator 146, and a reference-voltage generator 144 for generating a reference voltage 154 which is connected to the negative input of the comparator 146. Further, the system-voltage monitoring circuit 126 includes a plurality of voltage dividers including four resistor pairs [$R_g$, $R_g'$], [$R_h$, $R_h'$], [$R_i$, $R_i'$], and [$R_j$, $R_j'$], each resistor pair being interconnected at one node, respectively g, h, i, and j, which is further connected via one switch, respectively $S_g$, $S_h$, $S_i$, and $S_j$, to a common signal line connected to the positive input of the comparator 146. The potentials at the nodes g, h, i, and j are respectively designated by $V_g$, $V_h$, $V_i$, and $V_j$. The ON/OFF states of the switches [$S_g$, $S_h$, $S_i$, $S_j$] are controlled by the control circuit 142.

When the voltage-detection request signal 127 indicates the start-detection mode, the control circuit 142 will turn on the switches [$S_g$, $S_h$, $S_i$, $S_j$] in a sequential manner so as to compare each of the variously apportioned voltages [$V_g$, $V_h$, $V_i$, $V_j$] of the system voltage $V_{CC}$ one-by-one with the reference voltage 154. As a result of this, the comparator 146 generates a series of comparison signals on the output signal line 156 to the control circuit 142.

The control circuit 142 then processes these comparison signals to determine in which range the current level of the system voltage $V_{CC}$ lies, for example whether ($4.5V<V_{CC}$), or ($3.7V<V_{CC}<4.5V$), or ($2.8V<V_{CC}<3.7V$), or ($V_{CC}<2.8V$), and thereby outputs a voltage-level signal $V_{det}$ which indicates the range in which the current level of the system voltage $V_{CC}$ lies. On the other hand, when the voltage-detection request signal 127 indicates the stop-detection mode, the control circuit 142 will be disabled to stop detecting the current level of the system voltage $V_{CC}$.

Figure 15:
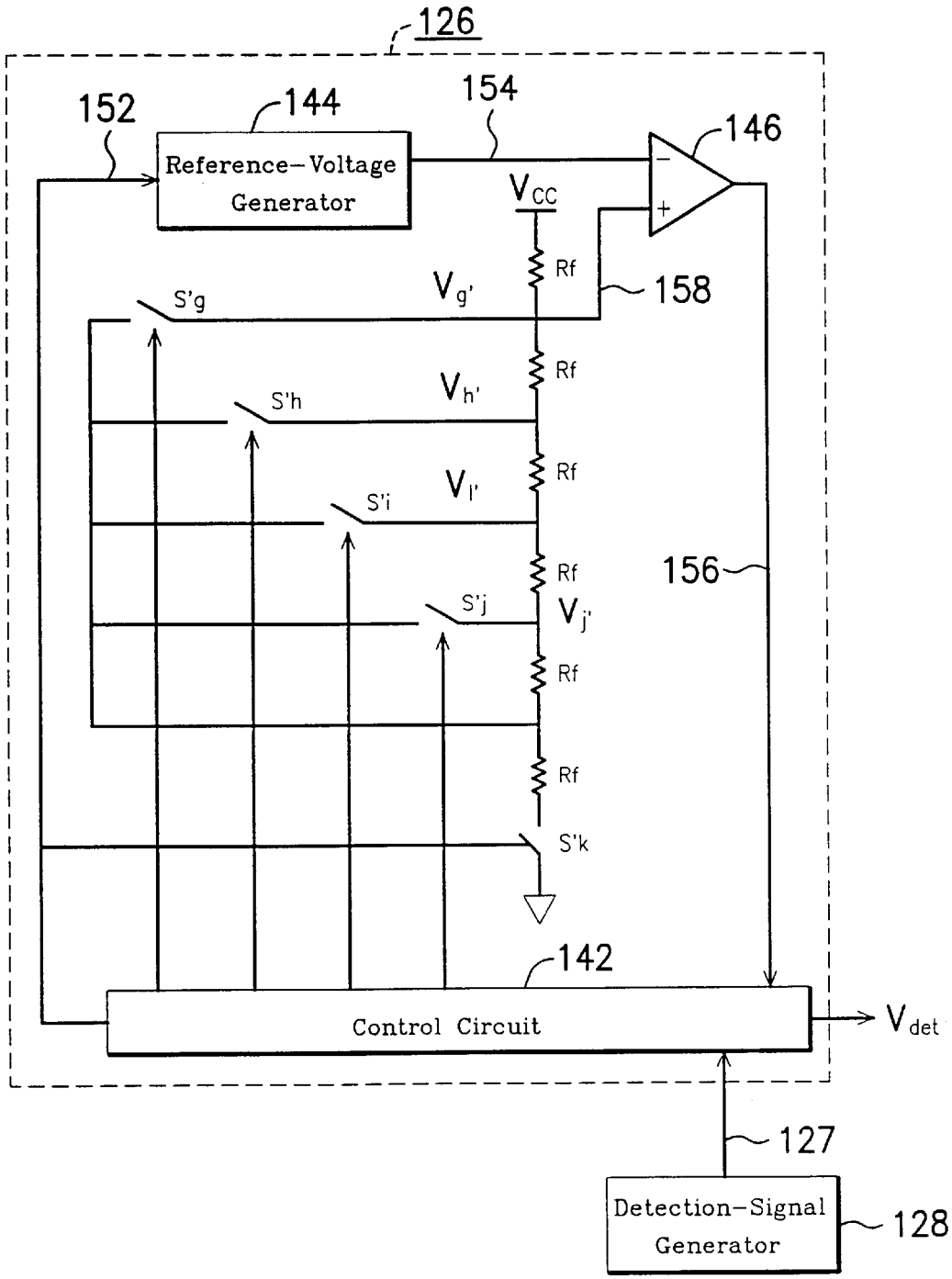
FIG. 15 is a detailed circuit diagram of a variation of the system-voltage monitoring circuit employed in the bias-voltage generating apparatus of the invention.

FIG. 15 shows a variation of the system-voltage monitoring circuit 126. The system-voltage monitoring circuit 126 here includes the same control circuit 142, reference-voltage generator 144, and comparator 146, but the voltage divider and associated switches are arranged in a different manner. The voltage divider here is composed of six serially connected resistors having a resistance $R_f$. The nodes between each neighboring pairs of the six resistors is connected to one switch, respectively $S_g'$, $S_h'$, $S_i'$, and $S_j'$. The topmost node is connected to the positive input of the comparator 146.

In the start-detection mode, the detection-signal generator 128 sends out a voltage-detection request signal 127 indicative of the current mode to the control circuit 142. In response to the voltage-detection request signal 127, the control circuit 142 will selectively turn on the switches [$S_g'$, $S_h'$, $S_i'$, $S_j'$] so as to vary the level of the voltage connected to the positive input of the comparator 146 to compare it with the reference voltage 154. The comparator 146 will accordingly generate a series of comparison signals indicative of which range the current level of the system voltage $V_{CC}$ lies. The control circuit 142 will process these comparison signals to thereby generate a voltage-level signal $V_{det}$ indicative of the range in which the current level of the system voltage $V_{CC}$ lies. On the other hand, if the voltage-detection request signal 127 indicates the stop-detection mode, the detection-signal generator 128 will disable the control circuit 142.

Figure 16:
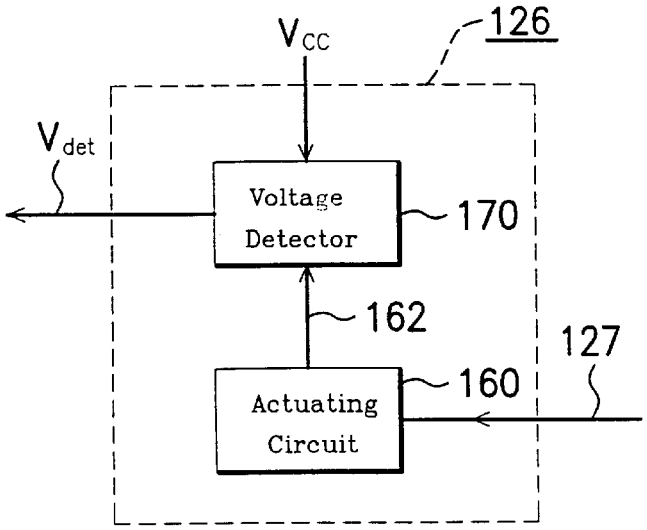
FIG. 16 is a detailed circuit block diagram of still another variation of the system-voltage monitoring circuit employed in the bias-voltage generating apparatus of the invention.

Referring to FIG. 16, there is shown another variation of the system-voltage monitoring circuit 126. The system-voltage monitoring circuit 126 here includes an actuating circuit 160 and a voltage detector 170 for detecting the current level of the system voltage $V_{CC}$. When the actuating circuit 160 receives the voltage-detection request signal 127 indicative of the start-detection mode, it will output an actuating signal 162 to the voltage detector 170 so as to actuate the voltage detector 170 to start detecting the current level of the system voltage $V_{CC}$.

Figure 17:
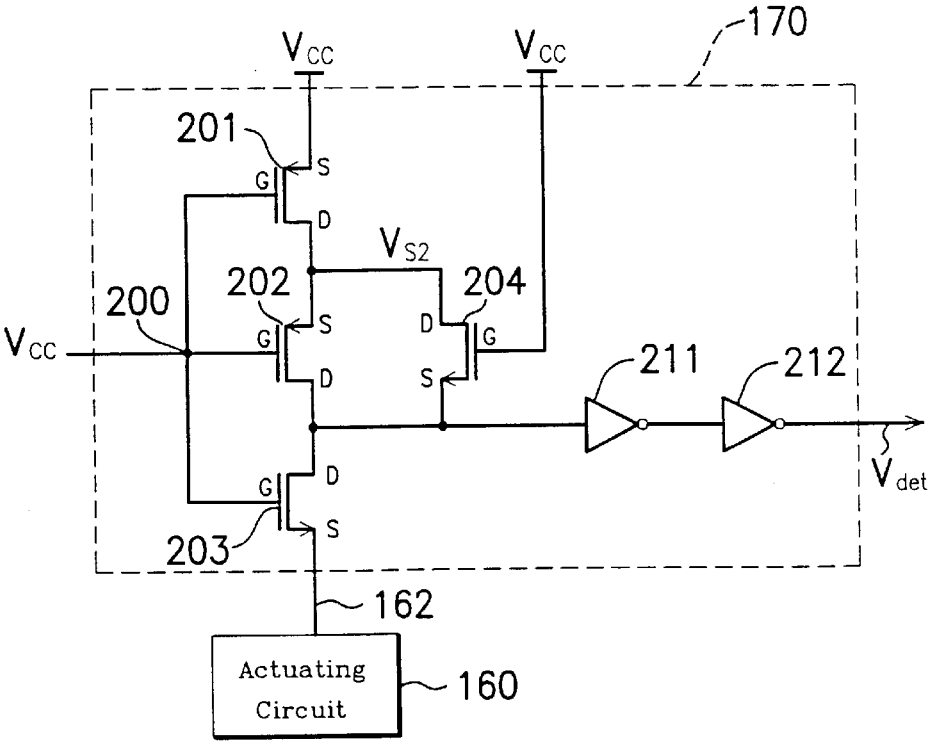
FIG. 17 is a detailed circuit diagram of the system-voltage monitoring circuit of FIG. 16.

Referring further to FIG. 17, there is shown a detailed circuit diagram of the voltage detector 170 shown in FIG. 16. As shown, the voltage detector 170 includes a first PMOS transistor 201, a second PMOS transistor 202, a first NMOS transistor 203, a second NMOS transistor 204, a first inverter 211, and a second inverter 212. The first PMOS transistor 201 and first NMOS transistor 203 together constitute a basic inverter.

The first PMOS transistor 201 has a source connected to $V_{CC}$, a drain connected to the source of the second PMOS transistor 202, and a gate connected to a common node 200 connected to $V_{CC}$. The second PMOS transistor 202 has a source connected to the drain of the first PMOS transistor 201, a drain connected to the drain of the first NMOS transistor 203, and a gate connected to the common node 200. The first NMOS transistor 203 has a source connected to the actuating circuit 160, a drain connected to the drain of the second PMOS transistor 202, and a gate connected to the common node 200. The second NMOS transistor 204 has a source connected to the drain of the second PMOS transistor 202 and first NMOS transistor 203, a drain connected to the drain of the first PMOS transistor 201 and the source of the second PMOS transistor 202, and a gate connected to $V_{CC}$. The first inverter 211 has an input connected to a node connecting the drain of the second PMOS transistor 202, the drain of the first NMOS transistor 203, and the source of the second NMOS transistor 204. The second inverter 212 is connected in subsequent cascade to the first inverter 211. The output of the second inverter 212 is the above-mentioned voltage-level signal $V_{det}$.

The forgoing voltage detector 170 has a transition voltage that will not be varied with the system voltage $V_{CC}$. Above the transition voltage, the voltage detector 170 will output a low voltage output indicative of a first logic state, while below the transition voltage, the voltage detector 170 will output a high voltage state indicative of a second logic state.

Figure 18:
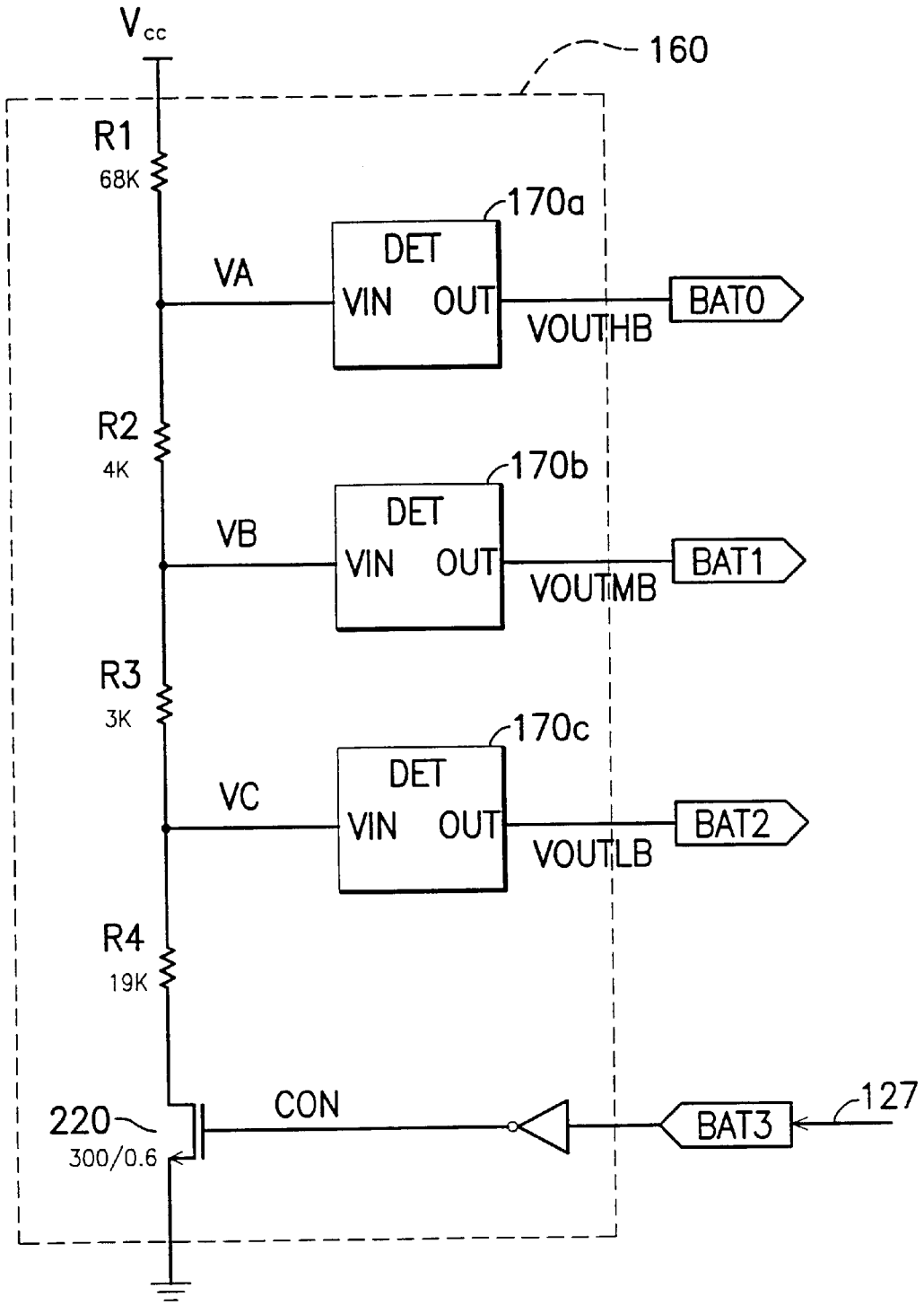
FIG. 18 is a schematic circuit diagram of a variation of the system-voltage monitoring circuit.

Referring to FIG. 18, there is shown a schematic circuit diagram of a variation of the system-voltage monitoring circuit 126. As shown, the circuit includes four serially connected resistors R1 (68 kΩ), R2 (4 kΩ), R3 (3 kΩ), R4 (19 kΩ). Further, an MOS transistor 220 is connected in series to the resistor R4 having a gate connected via an inverter to an input port BAT3 which receives the voltage-detection request signal 127. The three nodes connecting the four resistors [R1, R2, R3, R4 ] are respectively connected to three voltage detectors 170*a*, 170*b*, 170*c* each having a circuit structure shown in FIG. 17. The output ports of the voltage detectors 170*a*, 170*b*, 170*c* are respectively designated by BAT0, BAT1, and BAT2, while the input port for the voltage-detection request signal 127 is designated by BAT3.

In this embodiment, four ranges are predefined for representing the current level of the system voltage $V_{CC}$, respectively ($4.5V<V_{CC}$), ($3.7V<V_{CC}<4.5V$), ($2.8V<V_{CC}<3.7V$), and ($V_{CC}<2.8V$). When the voltage-detection request signal 127 is at a logic-1 state indicative of the start-detection mode, the MOS transistor 220 is turned on, allowing the voltage detectors 170*a*, 170*b*, 170*c* to start detecting the apportioned levels of the system voltage $V_{CC}$ by the four resistors R1 (68 kΩ), R2 (4 kΩ), R3 (3 kΩ), R4 (19 kΩ).

Figure 19:
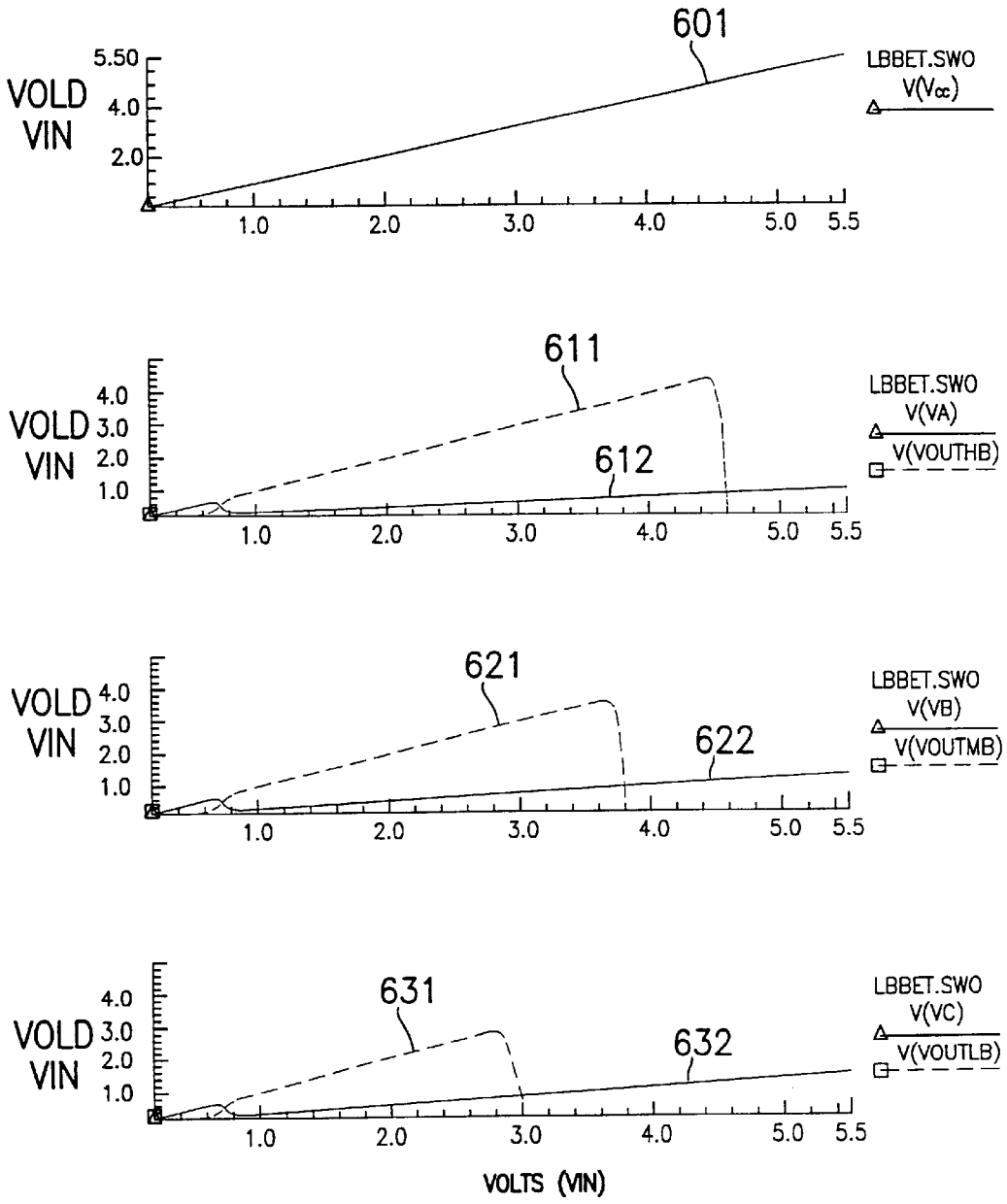
FIG. 19 shows a number of signal diagrams depicting the waveforms of the input and output voltage signals in the system-voltage monitoring circuit of FIG. 18.

Referring to FIG. 19, there are shown signal diagrams used to illustrate the changes of the apportioned voltages $V_A$, $V_B$, $V_C$ of the system voltage $V_{CC}$ and the output voltages $V_{OUTHB}$, $V_{OUTMB}$, $V_{OUTLB}$ of the voltage detectors 170*a*, 170*b*, 170*c* with respect to the change of the system voltage $V_{CC}$.

In the first signal diagram in FIG. 19, the curve 601 represents the variation of the system voltage $V_{CC}$ from 0 V to 5 V.

In the second signal diagram in FIG. 19, the dashed curve 611 represents the variation of the magnitude of the output voltage $V_{OUTHB}$ of the first voltage detector 170*a* with respect to the variation of the system voltage $V_{CC}$, and the solid curve 612 represents the variation of the magnitude of the first apportioned voltage $V_A$ of the system voltage $V_{CC}$ with respect to the same. The transition voltage of the first voltage detector 170*a* is set at 4.5V. Therefore, the output voltage $V_{OUTHB}$ will be switched from a low-voltage state to a high-voltage state when the system voltage $V_{CC}$ is lowered below 4.5V.

In the third signal diagram in FIG. 19, the dashed curve 621 represents the variation of the magnitude of the output voltage $V_{OUTMB}$ of the second voltage detector 170*b* with respect to the variation of the system voltage $V_{CC}$, and the solid curve 622 represents the variation of the magnitude of the second apportioned voltage $V_B$ of the system voltage $V_{CC}$ with respect to the same. The transition voltage of the second voltage detector 170*b* is set at 3.7V. Therefore, the output voltage $V_{OUTMB}$ will be switched from a low-voltage state to a high-voltage state when the system voltage $V_{CC}$ is lowered below 3.7 V In the fourth signal diagram in FIG. 19, the dashed curve 631 represents the variation of the magnitude of the output voltage $V_{OUTLB}$ of the third voltage detector 170*c* with respect to the variation of the system voltage $V_{CC}$, and the solid curve 632 represents the variation of the magnitude of the third apportioned voltage $V_C$ of the system voltage $V_{CC}$ with respect to the same. The transition voltage of the third voltage detector 170*c* is set at 2.8V. Therefore, the output voltage $V_{OUTLB}$ will be switched from a low-voltage state to a high-voltage state when the system voltage $V_{CC}$ is lowered below 2.8 V.

The logic voltage states of [$V_{OUTHB}$, $V_{OUTMB}$, $V_{OUTLB}$] with respect to the current level of the system voltage $V_{CC}$ are given in the following Table 3.

TABLE 3

| Current Level of $V_{CC}$ | $V_{OUTHB}$ | $V_{OUTMB}$ | $V_{OUTLB}$ |
|---|---|---|---|
| $4.5\ V < V_{CC}$ | L | L | L |
| $3.7\ V < V_{CC} < 4.5\ V$ | H | L | L |
| $2.8\ V < V_{CC} < 3.7\ V$ | H | H | L |
| $V_{CC} < 2.8\ V$ | H | H | H |

In the above Table 3, H represents a high-voltage state representing a first logic state, and L represents a low-voltage state representing a second logic state.

Figure 20:
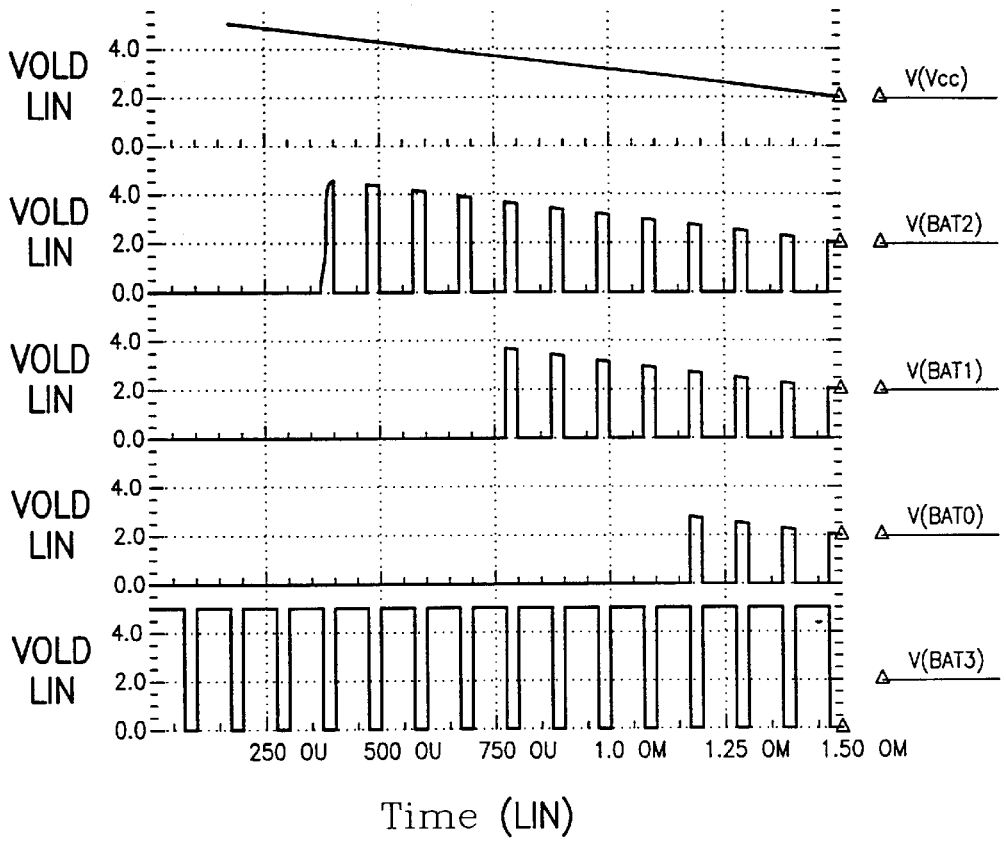
FIG. 20 shows a number of signal diagrams depicting the waveforms of the input and output voltage signals in the system-voltage monitoring circuit of FIG. 18.

FIG. 20 is a number of signal diagrams showing the variations of the waveforms of V(BAT0), V(BAT1), V(BAT2) with respect to the current level of the system voltage $V_{CC}$ when the voltage-detection request signal 127 received at the input port BAT3 is a train of pulses appearing at a fixed period. When the voltage-detection request signal 127 is null representing a low voltage logic state, it is inverted by the inverter to enable the MOS transistor 220 in FIG. 18, thus allowing the system voltage $V_{CC}$ to be divided by the resistors R1 (68 kΩ), R2 (4 kΩ), R3 (3 kΩ), R4 (19 kΩ) into the apportioned voltages [$V_A$, $V_B$, $V_C$] that are detected by the voltage detectors 170*a*, 170*b*, 170*c* to thereby output the pulses respectively designated by V(BAT0), V(BAT1), V(BAT2) in FIG. 20. From the states of these signals V(BAT0), V(BAT1), V(BAT2), the microprocessor 124*b* (FIG. 9) can in which range the current level of the system voltage $V_{CC}$ lies.

Method of the Invention

In accordance with the invention, there are disclosed four methods to operate the foregoing preferred embodiments of the bias-voltage generating apparatus to generate a set of bias voltages for the LCD driver 110 to generate a plurality of LCD waveforms to drive the LCD driver 110.

Method Associated with the First Preferred Embodiment

Based on the first preferred embodiment shown in FIG. 5, the procedural steps carried out by the bias-voltage generating apparatus of the invention to generate a set of bias voltages for the LCD driver 110 to drive the LCD panel 100 are described in the following.

(Step 1) Receive the system triggering signal 129 from the external system 121, and then generate the voltage-detection request signal 127;

(Step 2) If the voltage-detection request signal 127 is at a logic-1 state indicative of the start-detection mode, start detecting the system voltage $V_{CC}$ to thereby generate a voltage-level signal $V_{det}$ indicative of the current level of the system voltage $V_{CC}$;

(Step 3) In response to the voltage-level signal $V_{det}$, generate a control signal 125 by means of the logic circuit 124;

(Step 4) Input the control signal 125 to a digitally-variable resistor Rc connected to the voltage divider 122 so as to adjust the resistance of the digitally-variable resistor Rc accordingly, such that a bias current is flowing through the voltage divider 122 to form a number of bias voltages [$V_a$, $V_b$, $V_c$, $V_d$, $V_e$] for the LCD driver 110 to generate a plurality of LCD waveforms including common signals COM1–COM8 and segment signals SEG1–SEG40 to drive the LCD panel 100.

Method Associated with the Second Preferred Embodiment

Based on the second preferred embodiment shown in FIG. 6, the procedural steps carried out by the bias-voltage generating apparatus of the invention to generate a set of bias voltages for the LCD driver 110 to drive the LCD panel 100 are described in the following.

(Step 1) Receive the system triggering signal 129 from the external system 121, and then generate the voltage-detection request signal 127;

(Step 2) If the voltage-detection request signal 127 is at a logic-1 state indicative of the start-detection mode, start detecting the system voltage $V_{CC}$ and thereby generate a voltage-level signal $V_{det}$ indicative of the current level of the system voltage $V_{CC}$;

(Step 3) In response to the voltage-level signal $V_{det}$, generate a control signal 125 by means of the logic circuit 124;

(Step 4) Input the control signal 125 to a digitally-variable resistor Rc connected to the voltage divider 122 so as to adjust the resistance of the digitally-variable resistor Rc accordingly, such that a bias current is flowing through the voltage divider 122 to form a number of bias voltages [$V_a$, $V_b$, $V_c$, $V_d$, $V_e$];

(Step 5) Input the bias voltages [$V_a$, $V_b$, $V_c$, $V_d$, $V_e$] to the LCD driver 110 for the LCD driver 110 to generate a plurality of LCD waveforms including common signals COM1–COM8 and segment signals SEG1–SEG40 to drive the LCD panel 100.

(Step 6) Generate a switching signal LCDPULSE at the instance when the LCD waveforms are being switched from one state to another;

(Step 7) If LCDPULSE=1, turn on the switches [SW1, SW2, SW3, SW4, SW5 ] so as to connect the 10 kΩ resistors in parallel to the 100 kΩ resistors in the voltage divider 122 to provide a low overall equivalent resistance (9.09×5=45.45 kΩ) for the voltage divider 122, thereby switching the bias current $I_d$ to a top level; otherwise if LCDPULSE=0, turn off the switches [SW1, SW2, SW3, SW4, SW5] so as to disconnect the 10 kΩ resistors from the 100 kΩ resistors to provide a high overall equivalent resistance (100×5=500 kΩ) for the voltage divider 122, thereby lowering the bias current $I_d$ to a bottom level for reduced power consumption.

Method Associated with the Third Preferred Embodiment

Based on the third preferred embodiment shown in FIG. 7, the procedural steps carried out by the bias-voltage generating apparatus of the invention to generate a set of bias voltages for the LCD driver 110 to drive the LCD panel 100 are described in the following.

(Step 1) Receive the system triggering signal 129 from the external system 121, and then generate the voltage-detection request signal 127;

(Step 2) If the voltage-detection request signal 127 is at a logic-1 state indicative of the start-detection mode, start detecting the system voltage $V_{CC}$ to thereby generate a voltage-level signal $V_{det}$ indicative of the current level of the system voltage $V_{CC}$;

(Step 3) In response to the voltage-level signal $V_{det}$, generate a control signal 125 by means of the logic circuit 124;

(Step 4) Input the control signal 125 to a digitally-variable resistor Rc connected to the voltage divider 122 so as to adjust the resistance of the digitally-variable resistor Rc accordingly, such that a bias current $I_d$ is flowing through the voltage divider 122 to form a number of bias voltages [$V_a$, $V_b$, $V_c$, $V_d$, $V_e$];

(Step 5) Input the bias voltages [$V_a$, $V_b$, $V_c$, $V_d$, $V_e$] to the LCD driver 110 for the LCD driver 110 to generate a plurality of LCD waveforms including common signals COM1–COM8 and segment signals SEG1–SEG40 to drive the LCD panel 100.

(Step 6) Generate a switching signal LCDPULSE at the instance when the LCD waveforms are being switched from one state to another;

(Step 7) If LCDPULSE=1, turn on the switches [SW1, SW2, SW3, SW4, SW5 ] so as to short-circuit the 90 kΩ resistors in the voltage divider 122 to provide a low overall equivalent resistance (10 kΩ×5=50 kΩ) for the voltage divider 122, thereby switching the bias current $I_d$ to a top level; otherwise if LCDPULSE=0, turn off the switches [SW1, SW2, SW3, SW4, SW5 ] so as to connect the 90 kΩ resistors in series to the 10 kΩ resistors to provide a high overall equivalent resistance (100×5=500 kΩ) for the voltage divider 122, thereby lowering the bias current $I_d$ to a bottom level for reduced power consumption.

Method Associated with the Fourth Preferred Embodiment

Based on the fourth preferred embodiment shown in FIG. 8, the procedural steps carried out by the bias-voltage generating apparatus of the invention to generate a set of bias voltages for the LCD driver 110 to drive the LCD panel 100 are described in the following.

(Step 1) Receive the system triggering signal 129 from the external system 121, and then generate the voltage-detection request signal 127;

(Step 2) If the voltage-detection request signal 127 is at a logic-1 state indicative of the start-detection mode, start detecting the system voltage $V_{CC}$ to thereby generate a voltage-level signal $V_{det}$ indicative of the current level of the system voltage $V_{CC}$;

(Step 3) In response to the voltage-level signal $V_{det}$, generate a control signal 125 by means of the logic circuit 124;

(Step 4) Input the control signal 125 to a digitally-variable resistor Rc connected to the voltage divider 122 so as to adjust the resistance of the digitally-variable resistor Rc accordingly, such that a bias current is flowing through the voltage divider 122 to form a number of bias voltages [$V_a$, $V_b$, $V_c$, $V_d$, $V_e$];

(Step 5) Input the bias voltages [$V_a$, $V_b$, $V_c$, $V_d$, $V_e$] to the LCD driver 110 for the LCD driver 110 to generate a plurality of LCD waveforms including common signals COM1–COM8 and segment signals SEG1–SEG40 to drive the LCD panel 100.

(Step 6) Generate a switching signal LCDPULSE at the instance when the LCD waveforms are being switched from one state to another;

(Step 7) If LCDPULSE=1, turn on the switches [$S_a$, $S_b$, $S_c$, $S_d$, $S_e$] so as to connect the internal resistances $R_I$ thereof in parallel to the 100 kΩ resistors in the voltage divider 122 to provide a low overall equivalent resistance for the voltage divider 122, thereby switching the bias current $I_d$ to a top level; otherwise if LCDPULSE=0, turn off the switches [$S_a$, $S_b$, $S_c$, $S_d$, $S_e$] so as to disconnect internal resistances $R_I$ thereof from the 100 kΩ resistors to provide a high overall equivalent resistance (100×5=500 kΩ ) for the voltage divider 122, thereby lowering the bias current $I_d$ to a bottom level for reduced power consumption.

Conclusion

FIG. 12 shows typical signal diagrams of the LCD waveforms COM1, COM2, COM3 and SEGx generated by the LCD driver. These LCD waveforms are generated by the LCD driver 110 when the bias voltages $[V_a, V_b, V_c, V_d, V_e]$ are applied thereto.

Through experiments in which the LCD waveforms are displayed by oscilloscopes, the apparatus and method of the invention allows for a reduction of the spikes in the LCD waveforms at the instant when the LCD waveforms are being switched from one state to another by means of dynamically providing a low overall equivalent resistance to the voltage divider which divide the system voltage into the needed bias voltages. In other times, the overall equivalent resistance voltage divider is raised so as to maintain a low current level that allows for reduced power consumption.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. A bias-voltage generating apparatus for generating a set of bias voltages for an LCD driver to drive an LCD panel, comprising:

a voltage divider including a plurality of resistors and at least one digitally-variable resistor for dividing a system voltage into a number of apportioned voltages serving as the bias voltages, said plurality of resistors and said digitally-variable resistor being connected in series to form a DC path through which a bias current flows;

a system-voltage monitoring circuit for monitoring the system voltage to thereby generate a voltage-level signal indicative of the current level of the system voltage: and a logic circuit, in response to the voltage-level signal, for generating a contorl signal which adjusts the resistance of said digitally-variable resistor so as to adjust the bias current to a top level to allow the LCD driver to output a plurality of LCD wave-forms to drive the LCD panel, wherein said system-voltage monitoring circuit includes:

a reference-voltage generator for generating a reference voltage;

a plurality of voltage dividers, coupled to the system voltage, for generating a plurality of apportioned levels of the system voltage;

a plurality of switches connecting the plurality of apportioned levels of the system voltage to a common signal line;

a comparator having a negative input connected to receive the reference voltage and a positive input connected to the common signal line, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies.

2. A bias-voltage generating apparatus for generating a set of bias voltages for an LCD driver to drive an LCD panel, comprising:

a voltage divider including a plurality of resistors and at least one digitally-variable resistor for dividing a system voltage into a number of apportioned voltages serving as the bias voltages, said plurality of resistors and said digitally-variable resistor being connected in series to form a DC path through which a bias current flows;

a system-voltage monitoring circuit for monitoring the system voltage to thereby generate a voltage-level signal indicative of the current level of the system voltage; and a logic circuit, in response to the voltage-level signal, for generating a contorl signal which adjusts the resistance of said digitally-variable resistor so as to adjust the bias current to a top level to allow the LCD driver to output a plurality of LCD wave-forms to drive the LCD panel, wherein said system-voltage monitoring circuit includes:

a reference-voltage generator for generating a reference voltage;

a voltage divider including a plurality of serially connected resistors having one end coupled to the system voltage for generating a plurality of apportioned levels of the system voltage, said voltage divider including one node serving as an output thereof;

a plurality of switches connected across the resistors in said voltage divider in a predetermined manner such that a selected number of the resistors are short-circuited when said switches are selectively turned on, allowing the output of said voltage divider to send out one apportioned level of the system voltage;

a comparator having a negative input connected to receive the reference voltage and a positive input connected to the output of said voltage divider, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies.

3. A bias-voltage generating apparatus for generating a set of bias voltages for an LCD driver to drive an LCD panel, comprising:

a voltage divider including a plurality of resistors and at least one digitally-variable resistor for dividing a system voltage into a number of apportioned voltages serving as the bias voltages, said plurality of resistors and said digitally-variable resistor being connected in series to form a DC path through which a bias current flows;

a system-voltage monitoring circuit for monitoring the system voltage, said system-voltage monitoring circuit including:

a reference-voltage generator for generating a reference voltage;

a plurality of voltage dividers, coupled to the system voltage, for generating a plurality of apportioned levels of the system voltage;

a plurality of switches connecting respectively the plurality of apportioned levels of the system voltage to a common signal line;

a comparator having a negative input connected to receive the reference voltage and a positive input connected to the common signal line, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies; and a logic circuit, responsive to the voltage-level signal, for generating a control signal that adjusts the resistance of said digitally-variable resistor so as to adjust the magnitude of the bias current to allow the LCD driver to output a plurality of LCD waveforms.

4. The apparatus of claim 3, wherein the LCD waveforms includes a plurality of common signals and a plurality of segment signals.

5. The apparatus of claim 3, further comprising:

means for applying a counterbalancing potential to one end of the DC path opposite to the system voltage so as to cause the bias current flowing through the DC path to be zero.

6. A bias-voltage generating apparatus for generating a set of bias voltages for an LCD driver to drive an LCD panel, comprising:

a voltage divider including a plurality of resistors and at least one digitally-variable resistor for dividing a system voltage into a number of apportioned voltages serving as the bias voltages, said plurality of resistors and said digitally-variable resistor being connected in series to form a DC path through which a bias current flows;

a system-voltage monitoring circuit for monitoring the system voltage, said system-voltage monitoring circuit including:

a reference-voltage generator for generating a reference voltage;

a voltage divider including a plurality of serially connected resistors having one end coupled to the system voltage for generating a plurality of apportioned levels of the system voltage, said voltage divider including one node serving as an output thereof;

a plurality of switches connected across the resistors in said voltage divider in a predetermined manner such that a selected number of the resistors are short-circuited when said switches are selectively turned on, allowing the output of said voltage divider to send out one apportioned level of the system voltage;

a comparator having a negative input connected to receive the reference voltage and a positive input connected to the output of said voltage divider, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies; and a logic circuit, responsive to the voltage-level signal, for generating a control signal that adjusts the resistance of said digitally-variable resistor so as to adjust the magnitude of the bias current to allow the LCD driver to output a plurality of LCD waveforms.

7. The apparatus of claim 6, wherein the LCD waveforms includes a plurality of common signals and a plurality of segment signals.

8. The apparatus of claim 6, further comprising:

means for applying a counterbalancing potential to one end of the DC path opposite to the system voltage so as to cause the bias current flowing through the DC path to be zero.

9. A bias-voltage generating apparatus for generating a set of bias voltages for an LCD driver to drive an LCD panel, comprising:

a voltage divider including a plurality of resistors and at least one digitally-variable resistor for dividing a system voltage into a number of apportioned voltages serving as the bias voltages, said plurality of resistors and said digitally-variable resistor being connected in series to form a DC path through which a bias current flows;

a system-voltage monitoring circuit for monitoring the system voltage to thereby generate a voltage-level signal indicative of the current level of the system voltage; and a logic circuit coupled to said system-voltage monitoring circuit, said logic circuit including:

a microprocessor which generates a command signal in accordance with the voltage-level signal received from said system-voltage monitoring circuit; and a control circuit, responsive to the command signal from said microprocessor, for generating a control signal that adjusts the resistance of said digitally-variable resistor so as to adjust the magnitude of the bias current to allow the LCD driver to output a plurality of LCD waveforms.

10. The apparatus of claim 9, wherein the LCD waveforms includes a plurality of common signals and a plurality of segment signals.

11. The apparatus of claim 9, further comprising:

means for applying a counterbalancing potential to one end of the DC path opposite to the system voltage so as to cause the bias current flowing through the DC path to be zero.

12. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of resistors and at least one digitally-variable resistor for dividing the system voltage into a number of apportioned voltages serving as the bias voltages, said plurality of resistors and said digitally-variable resistor being connected in series to form a DC path through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit, coupled to receive the voltage-detection request signal from said detection-signal generator, for monitoring the system voltage to thereby generate a voltage-level signal indicative of the current level of the system voltage; and a logic circuit, responsive to the voltage-level signal, for generating a control signal that adjusts the resistance of said digitally-variable resistor based on the current level of the system voltage so as to adjust the magnitude of the bias current to allow the LCD driver to output a plurality of LCD waveforms.

13. The apparatus of claim 12, wherein the LCD waveforms includes a plurality of common signals and a plurality of segment signals.

14. The apparatus of claim 12, further comprising:

means for applying a counterbalancing potential to one end of the DC path opposite to the system voltage so as to cause the bias current flowing through the DC path to be zero.

15. The apparatus of claim 12, wherein said system-voltage monitoring circuit includes:

a reference-voltage generator for generating a reference voltage;

a plurality of voltage dividers, coupled to the system voltage, for generating a plurality of apportioned levels of the system voltage;

a plurality of switches connecting respectively the plurality of apportioned levels of the system voltage to a common signal line;

a comparator having a negative input connected to receive the reference voltage and a positive input connected to the common signal line, said comparator generating a series of comparison signals indicative of a specified voltage range within which the current level of the system voltage lies; and a control circuit coupled to said comparator and said plurality of switches;

wherein when said voltage-detection request signal indicates the start-detection mode, said control circuit selectively turns on said switches so as to allow said comparator to generate the comparison signals and then processes the comparison signals to thereby generate a voltage-level signal indicative of the range within which the current level of the system voltage lies.

16. The apparatus of claim 12, wherein said system-voltage monitoring circuit includes:

a reference-voltage generator for generating a reference voltage;

a voltage divider including a plurality of serially connected resistors having one end coupled to the system voltage for generating a plurality of apportioned levels of the system voltage, said voltage divider including one node serving as an output thereof;

a plurality of switches connected across the resistors in said voltage divider in a predetermined manner such that a selected number of the resistors are short-circuited when said switches are selectively turned on, allowing the output of said voltage divider to send out one apportioned level of the system voltage;

a comparator having a negative input connected to receive the reference voltage and a positive input connected to the output of said voltage divider, said comparator generating a series of comparison signals indicative of a specified voltage range within which the current level of the system voltage lies; and a control circuit coupled to said comparator and said plurality of switches;

wherein when said voltage-detection request signal indicates the start-detection mode, said control circuit selectively turns on said switches so as to allow said comparator to generate the comparison signals and then processes the comparison signals to thereby generate a voltage-level signal indicative of the range within which the current level of the system voltage lies.

17. The apparatus of claim 12, wherein said system-voltage monitoring circuit includes:

an actuating circuit, coupled to receive the voltage-detection request signal, for generating an actuating signal; and a voltage detector, responsive to the actuating signal, for detecting the current level of the system voltage and thereby generating a voltage-level signal indicative of the current level of the system voltage.

18. The apparatus of claim 17, wherein said voltage detector includes:

a first MOS transistor of a first type having a source, a drain, and a gate;

a second MOS transistor of a first type having a source, a drain, and a gate;

a third MOS transistor of a second type having a source, a drain, and a gate; and a fourth MOS transistor of a second type having a source, a drain, and a gate;

wherein the first MOS transistor has its source coupled to the system voltage, the gate coupled to the system voltage, and the drain connected to the source of the second MOS transistor;

the second MOS transistor has its source connected to the drain of said first MOS transistor, the drain connected to the drain of said third MOS transistor, and the gate coupled to the system voltage;

the third MOS transistor has its source coupled to receive the actuating signal from said actuating circuit, the drain connected to the drain of said second MOS transistor, and the gate coupled to the system voltage; and the fourth MOS transistor has its source connected to the drain of the second MOS transistor and the drain of the third MOS transistor, the drain connected to the drain of the first MOS transistor and the source of the second MOS transistor, and the gate coupled to the system voltage; and wherein the source of said fourth MOS transistor serves as an output to send out the voltage-level-signal that indicates the current level of the system voltage.

19. The apparatus of claim 18, wherein said first and second MOS transistors are P-type; and said third and fourth MOS transistors are N-type.

20. The apparatus of claim 19, wherein said first and second MOS transistors are N-type; and said third and fourth MOS transistors are P-type.

21. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit, coupled to receive the voltage-detection request signal from said detection-signal generator, for monitoring the system voltage to thereby generate a voltage-level signal indicative of the current level of the system voltage; and a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units each being connected across one of said first resistors in said voltage divider, each switching unit being controlled by the switching signal from said switching-signal generator;

wherein when the switching signal appears at one instant when the LCD waveforms are being switched from one state to another, each switching unit switches the equivalent resistance of the DC path through said voltage divider to a reduced level lower than the first resistance so as to raise the bias current to a top level; and when the switching signal is null, each switching unit switches the equivalent resistance of the DC path through said voltage divider back to the first resistance so as to lower the bias current to a bottom level.

22. The apparatus of claim 21, wherein each switching unit includes:

a switch controlled by the switching signal from the switching-signal generator; and a second resistor connected in series to said switch.

23. The apparatus of claim 22, wherein when the switching signal appears at one instant when the LCD waveforms are is switched from one state to another, said switch being closed-circuited so as to connect the second resistor in parallel to one of said first resistors to raise the bias current to the top level.

24. The apparatus of claim 23, wherein when the switching signal is null, each switch in said switching circuit is open-circuited such that each second resistor is disconnected from the associated first resistor so as to lower the bias current to the bottom level.

25. The apparatus of claim 24, wherein when the switching signal is at a logic-1 state, each switch is closed-circuited; and when the switching signal is at a logic-0 state, each switch is open-circuited.

26. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of resistor circuits and at least one digitally-variable resistor for dividing the system voltage into a number of apportioned voltages serving as the bias voltages, said plurality of resistor circuits and said digitally-variable resistor being connected in series to form a DC path through which a bias current flows, each resistor circuit including a first resistor and a second resistor connected in series with said first resistor;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit, coupled to receive the voltage-detection request signal from said detection-signal generator, for monitoring the system voltage to thereby generate a voltage-level signal indicative of the current level of the system voltage; and a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switches each being connected across one of said second resistors in said voltage divider, each switch being controlled by the switching signal from said switching-signal generator;

wherein when the switching signal appears at one instant when the LCD waveforms are being switched from one state to another, each switch is closed-circuited so as to short-circuit the second resistors, thereby switching the equivalent resistance of the DC path through said voltage divider to a reduced level so as to raise the bias current to a top level; and when the switching signal is null, each switch is open-circuited such that each second resistor is connected in series to the associated first resistor, thereby raising the equivalent resistance of the DC path through said voltage divider so as to lower the bias current to a bottom level.

27. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit, coupled to receive the voltage-detection request signal from said detection-signal generator, for monitoring the system voltage to thereby generate a voltage-level signal indicative of the current level of the system voltage; and a logic circuit, responsive, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units having an internal resistance, each switching unit being connected across one of said first resistors in said voltage divider, each switching unit being controlled by the switching signal from said switching-signal generator;

wherein when the switching signal appears at one instant when the LCD waveforms are is switched from one state to another, each switching unit being switched on such that the internal resistance thereof is connected in parallel to one of said first resistors in said voltage divider such that the equivalent resistance of the DC path through said voltage divider is lowered to a reduced level lower than the first resistance so as to raise the bias current to a top level; and when the switching signal is null, the internal resistance is disconnected from the associated first resistor such that the equivalent resistance of the DC path through said voltage divider is restored back to the first resistance so as to lower the bias current to a bottom level.

28. The apparatus of claim 27, wherein the internal resistance is lower than the resistance of said first resistors.

29. The apparatus of claim 28, wherein each of said switching units is a long-channel transmission gate.

30. The apparatus of claim 29, wherein said transmission gate is switched on when the switching signal is at a logic-1 state, and switched off when the switching signal is at a logic-0 state.

31. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

a reference-voltage generator for generating a reference voltage;

a plurality of voltage dividers, coupled to the system voltage, for generating a plurality of apportioned levels of the system voltage;

a plurality of switches connecting respectively the plurality of apportioned levels of the system voltage to a common signal line;

a comparator having a negative input connected to receive the reference voltage and a positive input connected to the common signal line, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies;

a logic circuit, responsive, for generating a control signal which adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units each being connected across one of said first resistors in said voltage divider, each switching unit being controlled by the switching signal from said switching-signal generator;

wherein when the switching signal appears at one instant when the LCD waveforms are being switched from one state to another, each switching unit switches the equivalent resistance of the DC path through said voltage divider to a reduced level lower than the first resistance so as to raise the bias current to a top level; and when the switching signal is null, each switching unit switches the equivalent resistance of the DC path through said voltage divider back to the first resistance so as to lower the bias current to a bottom level.

32. The apparatus of claim 31, wherein each switching unit including:

a switch whose on/off state being controlled by the switching signal from the switching-signal generator; and a second resistor connected in series to said switch.

33. The apparatus of claim 32, wherein when the switching signal appears at one instant when the LCD waveforms are being switched from one state to another, said switch is closed-circuited so as to connect the second resistor in parallel to one of said first resistors to raise the bias current to the top level; and when the switching signal is null, each switch in said switching circuit is open-circuited such that each second resistor is disconnected from the associated first resistor so as to lower the bias current to the bottom level.

34. The apparatus of claim 33, wherein when the switching signal is at a logic-1 state, each switch is closed-circuited; and when the switching signal is at a logic-0 state, each switch is open-circuited.

35. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

a reference-voltage generator for generating a reference voltage;

a plurality of voltage dividers, coupled to the system voltage, for generating a plurality of apportioned levels of the system voltage;

a plurality of switches connecting respectively the plurality of apportioned levels of the system voltage to a common signal line;

a comparator having a negative input connected to receive the reference voltage and a positive input connected to the common signal line, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switches each being connected across one of said second resistors in said voltage divider, each switch being controlled by the switching signal from said switching-signal generator;

wherein when the switching signal appears at one instant when the LCD waveforms are being switched from one state to another, each switch is closed-circuited so as to short-circuit the second resistors, thereby switching the equivalent resistance of the DC path through said voltage divider to a reduced level so as to raise the bias current to a top level; and when the switching signal is null, each switch is open-circuited such that each second resistor is connected in series to the associated first resistor, thereby raising the equivalent resistance of the DC path through said voltage divider so as to lower the bias current to a bottom level.

36. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of resistor circuits and at least one digitally-variable resistor for dividing the system voltage into a number of apportioned voltages serving as the bias voltages, said plurality of resistor circuits and said digitally-variable resistor being connected in series to form a DC path through which a bias current flows, each resistor circuit including a first resistor and a second resistor connected in series with said first resistor;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

a reference-voltage generator for generating a reference voltage;

a plurality of voltage dividers, coupled to the system voltage, for generating a plurality of apportioned levels of the system voltage;

a plurality of switches connecting respectively the plurality of apportioned levels of the system voltage to a common signal line;

a comparator having a negative input connected to receive the reference voltage and a positive input connected to the common signal line, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units having an internal resistance, each switching unit each being connected across one of said first resistors in said voltage divider, each switching unit being controlled by the switching signal from said switching-signal generator;

wherein when the switching signal appears at one instant when the LCD waveforms are being switched from one state to another, each switching unit is switched on such that the internal resistance thereof is connected in parallel to one of said first resistors in said voltage divider such that the equivalent resistance of the DC path through said voltage divider is lowered to a reduced level lower than the first resistance so as to raise the bias current to a top level; and when the switching signal is null, the internal resistance is disconnected from the associated first resistor such that the equivalent resistance of the DC path through said voltage divider is restored back to the first resistance so as to lower the bias current to a bottom level.

37. The apparatus of claim 36, wherein said first resistors are higher in resistance then said second resistors.

38. The apparatus of claim 37, wherein each of said switching units is a long-channel transmission gate.

39. The apparatus of claim 38, wherein said transmission gate is switched on when the switching signal is at a logic-1 state, and switched off when the switching signal is at a logic-0 state.

40. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

a reference-voltage generator for generating a reference voltage;

a voltage divider including a plurality of serially connected resistors having one end coupled to the system voltage for generating a plurality of apportioned levels of the system voltage, said voltage divider including one node serving as an output thereof;

a plurality of switches connected across the resistors in said voltage divider in a predetermined manner such that a selected number of the resistors are short-circuited when said switches are selectively turned on, allowing the output of said voltage divider to send out one apportioned level of the system voltage;

a comparator having a negative input connected to receive the reference voltage and a positive input connected to the output of said voltage divider, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units each being connected across one of said first resistors in said voltage divider, each switching unit being controlled by the switching signal from said switching-signal generator;

wherein when the switching signal appears at one instant when the LCD waveforms are being switched from one state to another, each switching unit switches the equivalent resistance of the DC path through said voltage divider to a reduced level lower than the first resistance so as to raise the bias current to a top level; and when the switching signal is null, each switching unit switches the equivalent resistance of the DC path through said voltage divider back to the first resistance so as to raise the bias current to a bottom level.

41. The apparatus of claim 40, wherein each switching unit includes:

a switch whose on/off state is controlled by the switching signal from the switching-signal generator; and a second resistor connected in series to said switch.

42. The apparatus of claim 41, wherein when the switching signal appears at one instant when the LCD waveforms are being switched from one state to another, said switch is closed-circuited so as to connect the second resistor in parallel to one of said first resistors to raise the bias current to the top level; and when the switching signal is null, each switch in said switching circuit is open-circuited such that each second resistor is disconnected from the associated first resistor so as to lower the bias current to the bottom level.

43. The apparatus of claim 42, wherein when the switching signal is at a logic-1 state, each switch is closed-circuited; and when the switching signal is at a logic0 state, each switch is open-circuited.

44. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of resistor circuits and at least one digitally-variable resistor for dividing the system voltage into a number of apportioned voltages serving as the bias voltages, said plurality of resistor circuits and said digitally-variable resistor being connected in series to form a DC path through which a bias current flows, each resistor circuit including a first resistor and a second resistor connected in series with said first resistor;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

a reference-voltage generator for generating a reference voltage;

a voltage divider including a plurality of serially connected resistors having one end coupled to the system voltage for generating a plurality of apportioned levels of the system voltage, said voltage divider including one node serving as an output thereof;

a plurality of switches connected across the resistors in said voltage divider in a predetermined manner such that a selected number of the resistors are short-circuited when said switches are selectively turned on, allowing the output of said voltage divider to send out one apportioned level of the system voltage;

a comparator having a negative input connected to receive the reference voltage and a positive input connected to the output of said voltage divider, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switches each being connected across one of said second resistors in said voltage divider, each switch being controlled by the switching signal from said switching-signal generator;

wherein when the switching signal appears at one instant when the LCD waveforms are being switched from one state to another, each switch is closed-circuited so as to short-circuit the second resistors, thereby switching the equivalent resistance of the DC path through said voltage divider to a reduced level so as to raise the bias current to a top level; and when the switching signal is null, each switch is open-circuited such that each second resistor is connected in series to the associated first resistor, thereby raising the equivalent resistance of the DC path through said voltage divider so as to lower the bias current to a bottom level.

45. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

a reference-voltage generator for generating a reference voltage;

a voltage divider including a plurality of serially connected resistors having one end coupled to the system voltage for generating a plurality of apportioned levels of the system voltage, said voltage divider including one node serving as an output thereof;

a plurality of switches connected across the resistors in said voltage divider in a predetermined manner such that a selected number of the resistors are short-circuited when said switches are selectively turned on, allowing the output of said voltage divider to send out one apportioned level of the system voltage;

a comparator having a negative input connected to receive the reference voltage and a positive input connected to the output of said voltage divider, said comparator generating a series of comparison signals indicative of a specified voltage range within which the current level of the system voltage lies; and a control circuit, coupled to said comparator and said plurality of switches, for selectively turning on said switches so as to allow said comparator to generate the comparison signals, said control circuit subsequently processing the comparison signals to thereby generate a voltage-level signal indicative of the range within which the current level of the system voltage lies;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units having an internal resistance, each switching unit each being connected across one of said first resistors in said voltage divider, each switching unit being controlled by the switching signal from said switching-signal generator;

wherein when the switching signal appears at one instant when the LCD waveforms are being switched from one state to another, each switching unit being switched on such that the internal resistance thereof is connected in parallel to one of said first resistors in said voltage divider such that the equivalent resistance of the DC path through said voltage divider is lowered to a reduced level lower than the first resistance so as to raise the bias current to a top level; and when the switching signal is null, the internal resistance is disconnected from the associated first resistor such that the equivalent resistance of the DC path through said voltage divider is restored back to the first resistance so as to lower the bias current to a bottom level.

46. The apparatus of claim 45, wherein the internal resistance is lower than the resistance of said first resistors.

47. The apparatus of claim 45, wherein each of said switching units is a long-channel transmission gate.

48. The apparatus of claim 47, wherein said transmission gate is switched on when the switching signal is at a logic-1 state, and switched off when the switching signal is at a logic-0 state.

49. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

an actuating circuit, coupled to receive the voltage-detection request signal, for generating an actuating signal; and a voltage detector, responsive to the actuating signal, for detecting the current level of the system voltage and thereby generating a voltage-level signal indicative of the current level of the system voltage;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units each being connected across one of said first resistors in said voltage divider, each switching unit being controlled by the switching signal from said switching-signal generator;

wherein when the switching signal appears at one instant when the LCD waveforms are being switched from one state to another, each switching unit switches the equivalent resistance of the DC path through said voltage divider to a reduced level lower than the first resistance so as to raise the bias current to a top level; and when the switching signal is null, each switching unit switches the equivalent resistance of the DC path through said voltage divider back to the first resistance so as to lower the bias current to a bottom level.

50. The apparatus of claim 49, herein each switching unit includes:

a switch whose on/off state is controlled by the switching signal from the switching-signal generator; and a second resistor connected in series to said switch.

51. The apparatus of claim 50, wherein when the switching signal appears at one instant when the LCD waveforms are is switched from one state to another, said switch being closed-circuited so as to connect the second resistor in parallel to one of said first resistors to raise the bias current to the top level; and when the switching signal is null, each switch in said switching circuit is open-circuited such that each second resistor is disconnected from the associated first resistor so as to lower the bias current to the bottom level.

52. The apparatus of claim 51, wherein when the switching signal is at a logic-1 state, each switch is closed-circuited; and when the switching signal is at a logic-0 state, each switch is open-circuited.

53. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of resistor circuits and at least one digitally-variable resistor for dividing the system voltage into a number of apportioned voltages serving as the bias voltages, said plurality of resistor circuits and said digitally-variable resistor being connected in series to form a DC path through which a bias current flows, each resistor circuit including a first resistor and a second resistor connected in series with said first resistor;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

an actuating circuit, coupled to receive the voltage-detection request signal, for generating an actuating signal; and a voltage detector, responsive to the actuating signal, for detecting the current level of the system voltage and thereby generating a voltage-level signal indicative of the current level of the system voltage;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switches each being connected across one of said second resistors in said voltage divider, each switch being controlled by the switching signal from said switching-signal generator;

wherein when the switching signal appears at one instant when the LCD waveforms are being switched from one state to another, each switch is closed-circuited so as to short-circuit the second resistors, thereby switching the equivalent resistance of the DC path through said voltage divider to a reduced level so as to raise the bias current to a top level; and when the switching signal is null, each switch is open-circuited such that each second resistor is connected in series to the associated first resistor, thereby raising the equivalent resistance of the DC path through said voltage divider so as to lower the bias current to a bottom level.

54. A bias-voltage generating apparatus for generating a set of bias voltages for an LCD driver to drive an LCD panel, said bias-voltage generating apparatus being coupled to an external system to receive a system voltage and a system triggering signal therefrom, said bias-voltage generating apparatus comprising:

a voltage divider including a plurality of first resistors and at least one digitally-variable resistor for dividing the system voltage into a number of apportioned voltages serving as the bias voltages, said plurality of first resistors and said digitally-variable resistor being connected in series to form a DC path having a first resistance through which a bias current flows;

a detection-signal generator, coupled to receive the system triggering signal from the external system, for generating a voltage-detection request signal having a first logic state indicative of a start-detection mode and a second logic state indicative of a stop-detection mode;

a system-voltage monitoring circuit coupled to receive the voltage-detection request signal from said detection-signal generator, said system-voltage monitoring circuit including:

an actuating circuit, coupled to receive the voltage-detection request signal, for generating an actuating signal; and a voltage detector, responsive to the actuating signal, for detecting the current level of the system voltage and thereby generating a voltage-level signal indicative of the current level of the system voltage;

a logic circuit, responsive to the voltage-level signal, for generating a control signal that adjusts the resistance of said digitally-variable resistor to a prescribed value based on the current level of the system voltage, so as to adjust the magnitude of the bias current to allow the LCD driver to output a plurality of LCD waveforms;

a switching-signal generator capable of generating one pulse representing a switching signal at each instance the LCD waveforms are being switched from one state to another; and a switching circuit including a plurality of switching units having an internal resistance, each switching unit being connected across one of said first resistors in said voltage divider, each switching unit being controlled by the switching signal from said switching-signal generator;

wherein when the switching signal appears at one instant when the LCD waveforms are being switched from one state to another, each switching unit is switched on such that the internal resistance thereof is connected in parallel to one of said first resistors in said voltage divider such that the equivalent resistance of the DC path through said voltage divider is lowered to a reduced level lower than the first resistance so as to raise the bias current to a top level; and when the switching signal is null, the internal resistance is disconnected from the associated first resistor such that the equivalent resistance of the DC path through said voltage divider is restored back to the first resistance so as to lower the bias current to a bottom level.

55. The apparatus of claim 54, wherein the internal resistance is lower than the resistance of said first resistors.

56. The apparatus of claim 54, wherein each of said switching units is a long-channel transmission gate.

57. The apparatus of claim 56, wherein said transmission gate is switched on when the switching signal is at a logic-1 state, and switched off when the switching signal is at a logic-0 state.

58. A method for generating a set of bias voltages for an LCD driver to drive an LCD panel, the bias voltages being obtained by means of a voltage divider dividing a system voltage into a number of apportioned voltages serving as the bias voltages, said method comprising the steps of:

(1) detecting the current level of the system voltage to thereby generate a voltage-level signal indicative of the current level of the system voltage;

(2) in response to the voltage-level signal, generating a logic control signal; and (3) applying the logic control signal to a digitally-variable resistor connected in series to the voltage divider so as to adjust the magnitude of a bias current flowing through the voltage divider, the bias current being switched to a top level when the LCD driver needs to generate a plurality of LCD waveforms to the LCD panel, and switched to a bottom level when the LCD driver is not in use.

59. The method of claim 58, wherein the LCD waveforms includes a plurality of common signals and a plurality of segment signals.

60. The method of claim 58, further comprising a step of:

applying a counterbalancing potential to one end of the DC path opposite to the system voltage so as to cause the bias current flowing through the DC path to be zero.

61. A method for generating a set of bias voltages for an LCD driver to drive an LCD panel, the bias voltages being obtained by means of a voltage divider dividing a system voltage into a number of apportioned voltages serving as the bias voltages, said method comprising the steps of:

(1) in response to a system triggering signal from an external system, generating a voltage-detection request signal;

(2) determining whether the system triggering signal indicates a start-detection mode;

if yes, detecting the current level of the system voltage and thereby generating a voltage-level signal indicative of the current level of the system voltage;

(3) in response to the voltage-level signal, generating a logic control signal; and (4) applying the logic control signal to a digitally-variable resistor connected in series to the voltage divider so as to adjust the magnitude of a bias current flowing through the voltage divider, the bias current being switched to a top level when the LCD driver needs to generate a plurality of LCD waveforms to the LCD panel, and switched to a bottom level when the LCD driver is not in use.

62. A method for generating a set of bias voltages for an LCD driver to drive an LCD panel, the bias voltages being obtained by means of a voltage divider dividing a system voltage into a number of apportioned voltages serving as the bias voltages, said voltage divider including a plurality of first resistors and at least one digitally-variable resistor, said plurality of first resistors and said digitally-variable resistor being connected in series to form a DC path having a first resistance through which a bias current flows, said method comprising the steps of:

(1) in response to a system triggering signal from an external system, generating a voltage-detection request signal;

(2) determining whether the system triggering signal indicates a start-detection mode;

if yes, detecting the current level of the system voltage and thereby generating a voltage-level signal indicative of the current level of the system voltage;

(3) in response to the voltage-level signal, generating a logic control signal;

(4) applying the logic control signal to the digitally-variable resistor connected in series to the voltage divider so as to raise the magnitude of the bias current flowing through the voltage divider, allowing the generation of the bias voltages from the voltage divider;

(5) inputting the bias voltages to the LCD driver to cause the LCD driver to generate a plurality of LCD waveforms;

(6) at each instant when the LCD waveforms are being switched from one state to another, generating a switching signal; and (7) inputting the switching signal to a switching circuit including a plurality of switching units each being connected across one of said first resistors in said voltage divider, each switching unit being controlled by the switching signal;

wherein when the switching signal appears at one instant when the LCD waveforms are being switched from one state to another, each switching unit switches the equivalent resistance of the DC path through said voltage divider to a reduced level lower than the first resistance so as to raise the bias current to a top level; and when the switching signal is null, each switching unit switches the equivalent resistance of the DC path through said voltage divider back to the first resistance so as to lower the bias current to a bottom level.

63. The method of claim 62, wherein each switching unit includes:

a switch whose on/off state is controlled by the switching signal from the switching-signal generator; and a second resistor connected in series to said switch.

64. The apparatus of claim 63, wherein said second resistor is lower in resistance than said first resistors in said voltage divider.

65. The apparatus of claim 64, wherein when the switching signal appears at one instant when the LCD waveforms are being switched from one state to another, said switch is closed-circuited so as to connect the second resistor in parallel to one of said first resistors to raise the bias current to the top level;

when the switching signal is null, each switch in said switching circuit is open-circuited such that each second resistor is disconnected from the associated first resistor so as to lower the bias current to the bottom level.

66. The apparatus of claim 65, wherein when the switching signal is at a logic-1 state, each switch is closed-circuited; and when the switching signal is at a logic-0 state, each switch is open-circuited.

67. A method for generating a set of bias voltages for an LCD driver to drive an LCD panel, the bias voltages being obtained by means of a voltage divider dividing a system voltage into a number of apportioned voltages serving as the bias voltages, said voltage divider including a plurality of first resistors and at least one digitally-variable resistor, said plurality of first resistors and said digitally-variable resistor being connected in series to form a DC path having a first resistance through which a bias current flows, said method comprising the steps of:

(1) in response to a system triggering signal from an external system, generating a voltage-detection request signal;

(2) determining whether the system triggering signal indicates a start-detection mode;

if yes, detecting the current level of the system voltage and thereby generating a voltage-level signal indicative of the current level of the system voltage;

(3) in response to the voltage-level signal, generating a logic control signal; and (4) applying the logic control signal to the digitally-variable resistor connected in series to the voltage divider so as to raise the magnitude of the bias current flowing through the voltage divider, allowing the generation of the bias voltages from the voltage divider;

(5) inputting the bias voltages to the LCD driver to cause the LCD driver to generate a plurality of LCD waveforms;

(6) at each instant when the LCD waveforms are being switched from one state to another, generating a switching signal; and (7) inputting the switching signal to a switching circuit including a plurality of switching units having an internal resistance, each switching unit each being connected across one of said first resistors in said voltage divider, each switching unit being controlled by the switching signal;

wherein when the switching signal appears at one instant when the LCD waveforms are being switched from one state to another, each switching unit being switched on such that the internal resistance thereof is connected in parallel to one of said first resistors in said voltage divider such that the equivalent resistance of the DC path through said voltage divider is lowered to a reduced level lower than the first resistance so as to raise the bias current to a top level; and when the switching signal is null, the internal resistance is disconnected from the associated first resistor such that the equivalent resistance of the DC path through said voltage divider is restored back to the first resistance so as to lower the bias current to a bottom level.

68. The method of claim 67, wherein the internal resistance is lower than the resistance of said first resistors.

69. A method for generating a set of bias voltages for an LCD driver to drive an LCD panel, the bias voltages being obtained by means of a voltage divider dividing a system voltage into a number of apportioned voltages serving as the bias voltages, said voltage divider including a plurality of resistor circuits and at least one digitally-variable resistor, said plurality of resistor circuits and said digitally-variable resistor being connected in series to form a DC path through which a bias current flows, each resistor circuit including a first resistor and a second resistor connected in series with said first resistor, said method comprising the steps of:

(1) in response to a system triggering signal from an external system, generating a voltage-detection request signal;

(2) determining whether the system triggering signal indicates a start-detection mode;

if yes, detecting the current level of the system voltage and thereby generating a voltage-level signal indicative of the current level of the system voltage;

(3) in response to the voltage-level signal, generating a logic control signal;

(4) applying the logic control signal to the digitally-variable resistor connected in series to the voltage divider so as to raise the magnitude of the bias current flowing through the voltage divider, allowing the generation of the bias voltages from the voltage divider;

(5) inputting the bias voltages to the LCD driver to cause the LCD driver to generate a plurality of LCD waveforms;

(6) at each instant when the LCD waveforms are being switched from one state to another, generating a switching signal; and (7) inputting the switching signal to a switching circuit including a plurality of switches each being connected across one of said second resistors in said voltage divider, each switch being controlled by the switching signal from said switching-signal generator, wherein when the switching signal appears at one instant when the LCD waveforms are being switched from one state to another, each switch is closed-circuited so as to short-circuit the second resistors, thereby switching the equivalent resistance of the DC path through said voltage divider to a reduced level so as to raise the bias current to a top level; and when the switching signal is null, each switch is open-circuited such that each second resistor is connected in series to the associated first resistor, thereby raising the equivalent resistance of the DC path through said voltage divider so as to lower the bias current to a bottom level.

* * * * *